US011229814B1

(12) United States Patent
Weck et al.

(10) Patent No.: US 11,229,814 B1
(45) Date of Patent: Jan. 25, 2022

(54) DYNAMIC TRAINING DEVICE

(71) Applicant: BOSU Fitness, LLC, Wilmington, DE (US)

(72) Inventors: David S. Weck, San Diego, CA (US); Marty Shannon, San Diego, CA (US)

(73) Assignee: BOSU Fitness, LLC, Wilmington, DE (US)

( * ) Notice: Subject to any disclaimer, the term of this patent is extended or adjusted under 35 U.S.C. 154(b) by 0 days.

(21) Appl. No.: 17/243,014

(22) Filed: Apr. 28, 2021

(51) Int. Cl.

| | |
|---|---|
| ***A63B 5/20*** | (2006.01) |
| ***A63B 21/00*** | (2006.01) |
| ***A63B 21/055*** | (2006.01) |
| ***A63B 21/06*** | (2006.01) |

(52) U.S. Cl.
CPC ..... *A63B 5/20* (2013.01); *A63B 21/0555* (2013.01); *A63B 21/4035* (2015.10); *A63B 21/0608* (2013.01)

(58) Field of Classification Search
CPC .. A63B 5/00; A63B 5/20; A63B 5/205; A63B 21/0004; A63B 21/00043; A63B 21/00058; A63B 21/00061; A63B 21/00065; A63B 21/00069; A63B 21/02; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/0608; A63B 21/15; A63B 21/151; A63B 21/4027; A63B 21/4033; A63B 21/4035; A63B 21/4043; A63B 2208/0204; A63B 2208/0209; A63B 2209/00; A63B 2225/09
See application file for complete search history.

(56) References Cited

U.S. PATENT DOCUMENTS

| | | | | |
|---|---|---|---|---|
| 1,817,616 A * | 8/1931 | Goff | A63B 5/20 482/82 |
| 4,094,502 A * | 6/1978 | Cook | A63B 5/20 482/81 |
| 4,109,906 A * | 8/1978 | Wilson | A63B 5/20 482/110 |
| 4,505,474 A * | 3/1985 | Mattox | A63B 5/20 482/82 |
| 4,625,963 A * | 12/1986 | Lancellotti | A63B 21/04 482/130 |
| 5,190,508 A * | 3/1993 | Kliewer | A63B 5/20 482/82 |

(Continued)

FOREIGN PATENT DOCUMENTS

WO 2017031307 A2 2/2017

*Primary Examiner* — Gary D Urbiel Goldner
(74) *Attorney, Agent, or Firm* — Lerner, David, Littenberg, Krumholz & Mentlik, LLP

(57) ABSTRACT

Training devices having at least two elastic members connected to a respective end of an inelastic member are disclosed. The training devices comprise first and second handles coupled to a respective one of the two elastic members. The training devices may be used to add various strength training modalities to a cardiovascular workout or fitness regimen. The training device may be provided in the form of a kit including elastic and inelastic members having differing elasticities, lengths, and widths and including removable handles, potentially of differing types.

21 Claims, 21 Drawing Sheets

(56) References Cited

U.S. PATENT DOCUMENTS 6,540,649 B1* 4/2003 Niedrich ..... A63B 5/20 482/109
6,752,746 B1 6/2004 Winkler et al.
7,794,374 B1 9/2010 Park
8,684,894 B2 4/2014 Flynn
8,870,722 B2 10/2014 Kassel
8,944,976 B2 2/2015 Crowell et al.
9,248,331 B1 2/2016 Collier et al.
9,630,081 B2 4/2017 Gillespie
9,757,604 B2 9/2017 Carter
D850,546 S 6/2019 Reese
10,610,722 B2 4/2020 Roberts
2004/0127339 A1* 7/2004 Finn ..... A63B 21/00181 482/140
2004/0157710 A1* 8/2004 Basting ..... A63B 21/0004 482/126
2005/0113220 A1* 5/2005 Dovner ..... A63B 21/4001 482/121
2005/0113221 A1* 5/2005 Dovner ..... A63B 21/0004 482/121
2005/0113222 A1* 5/2005 Dovner ..... A63B 21/0004 482/121
2005/0113223 A1* 5/2005 Dovner ..... A63B 21/0552 482/121
2005/0113224 A1* 5/2005 Dovner ..... A63B 21/00185 482/121
2005/0113225 A1* 5/2005 Dovner ..... A63B 21/0004 482/121
2006/0094573 A1* 5/2006 Weck ..... A63B 21/0552 482/126
2007/0191194 A1* 8/2007 Joy ..... A63B 5/20 482/81
2008/0009398 A1* 1/2008 Grisdale ..... A63B 21/0552 482/124
2009/0275450 A1* 11/2009 Best ..... A63B 21/0023 482/142
2010/0041527 A1* 2/2010 Miller ..... A63B 21/4015 482/124
2012/0329618 A1* 12/2012 White ..... A63B 21/1636 482/126
2013/0157817 A1 6/2013 Green
2013/0165301 A1 6/2013 Thrasher-Rudd et al.
2013/0190148 A1* 7/2013 Allison ..... A63B 21/0442 482/129
2014/0031181 A1* 1/2014 Agostini ..... A63B 21/0552 482/129
2014/0073496 A1* 3/2014 Bannerman ..... A63B 23/0355 482/139
2014/0113777 A1 4/2014 Pahl
2014/0155233 A1* 6/2014 Latronica ..... A63B 21/4033 482/124
2014/0228180 A1 8/2014 Walker
2015/0141217 A1 5/2015 Young
2015/0283420 A1* 10/2015 Chang ..... A63B 23/1281 482/129
2016/0193490 A1* 7/2016 Chen ..... A63B 21/4035 482/126
2019/0126086 A1 5/2019 Tousant
2019/0201732 A1* 7/2019 Chang ..... A63B 21/0557
2019/0290986 A1* 9/2019 Cobb ..... A63B 69/0002
2021/0023413 A1* 1/2021 Nurge ..... A63B 21/065
2021/0170216 A1* 6/2021 Cone ..... A63B 21/4035

* cited by examiner

DYNAMIC TRAINING DEVICE

BACKGROUND OF THE INVENTION

Jumping rope is an exercise that may be used for weight-loss, cardiovascular training, and heart health. The functionality of a jump rope however is generally mostly limited to an overhead or side to side swinging motion while jumping. A jump rope may therefore be of relatively little use to a user seeking strength training, variable isotonic exercise, resistance training, unilateral training, non-dominant side training or mobility training.

Moreover, the cordage of jump ropes is not typically easily changeable in more than one property thereof, including length, weight, elasticity, and symmetry, for example. Thus, if a user wishes to change one or more of these properties, the user must generally acquire a different jump rope altogether. There therefore exists a need for a robust multi-functional jump rope system that can be used for both cardiovascular fitness and strength training, for example, while providing a user with options for varying the properties thereof so that specific and tailored workout and fitness goals for a user may be achieved.

BRIEF SUMMARY OF THE INVENTION

Disclosed herein is a training and exercise device that incorporates the qualities of a jump rope, resistance band and free weights together in one. While the training device generally includes first and second handles it also includes an elongate body portion. The body portion includes at least three separable members, namely first and second elastic members and an intermediate member. Each of the first and second elastic members is couplable to either of the first and second handles and the intermediate member. The first and second elastic members each have an elastic portion and an inelastic portion. The inelastic portion of the first and second elastic members may be coupled proximate to either of the first and second handles or the intermediate member based on the desired workout or fitness goal.

In one aspect, a training device comprises a first handle, a second handle, a first elastic member having opposing ends, one of the opposing ends of the first elastic member coupled to the first handle, a second elastic member having opposing ends, one of the opposing ends of the second elastic member coupled to the second handle, and an intermediate member having opposing ends, a first of the opposing ends of the intermediate member coupled to the other of the opposing ends of the first elastic member and a second of the opposing ends of the intermediate member coupled to the other of the opposing ends of the second elastic member.

In one embodiment of this aspect, the first and second elastic members have a neutral length between six and twenty four inches.

In another embodiment of this aspect, the first and second elastic members have a neutral length and an extended length that is greater than the neutral length.

In yet another embodiment of this aspect, the intermediate portion is inelastic.

In still yet another embodiment of this aspect, the first elastic and second members each have an elastic portion and an inelastic portion. The inelastic portion of each of the first and second elastic members may be couplable proximate to a respective one of the first and second handles. The inelastic portion of each of the first and second elastic members may be couplable proximate to either of the opposing ends of the intermediate member.

In still yet another embodiment of this aspect, the first and second handles are elongate and have an end coupled to the respective one of the opposing ends of the first and second elastic members.

In still yet another embodiment of this aspect, wherein the first and second elastic members have a different resistance to one another.

In another aspect, a training device comprises a first pair of elastic members each having a first end and a second end, and a first intermediate member having opposing ends, wherein each of the opposing ends of the first intermediate member is couplable to either of the first and second ends of each of the first pair of elastic members.

In one embodiment of this aspect, the training device further comprises first and second handles each having a connection end, wherein the connection end of each of the first and second handles is couplable to either of the first and second ends of the first pair of elastic members.

In another embodiment of this aspect, the training device further comprises a second pair of elastic members each having a first end and a second end, wherein each of the opposing ends of the first intermediate member is couplable to either of the first and second ends of each of the second pair of elastic members.

In yet another embodiment of this aspect, the first pair of elastic members have a different neutral length than the second pair of elastic members.

In yet another embodiment of this aspect, wherein the first pair of elastic members have a different resistance than the second pair of elastic members.

In still yet another embodiment of this aspect, the training device further comprises a second intermediate member having opposing ends, wherein the first intermediate member has a first length and the second intermediate members has a second length greater than the first length.

In still yet another embodiment of this aspect, each of the first pair of elastic members has an elastic portion and an inelastic portion. The inelastic portion of each of the first pair of elastic members may be couplable proximate to either of the opposing ends of the first intermediate member.

In still yet another embodiment of this aspect, the training device further comprises first and second handles each having a connection end, wherein the connection end of the first handle is couplable to the elastic portion of one of the first pair of elastic members and the connection end of the second handle is couplable to the inelastic portion of the other of the first pair of elastic members. The inelastic portion of the one of the first pair of elastic members may be couplable to one of the opposing ends of the intermediate member and the elastic portion of the other of the first pair of elastic members may be couplable to the other of the opposing ends of the intermediate member.

In another aspect, a training device comprises first and second elongate handles each having a gripping portion and a coupling portion, a first elastic member having a first end coupled to the coupling portion of the first handle, a second elastic member having a first end coupled to the coupling portion of the second handle, and an inelastic intermediate member having first and second ends, the first end coupled to a second end of the first elastic member and the second end coupled to a second end of the second elastic member.

In one embodiment of this aspect, each of the first and second elastic members have a neutral length and an extended length greater than the neutral length.

DETAILED DESCRIPTION

Figure 1:
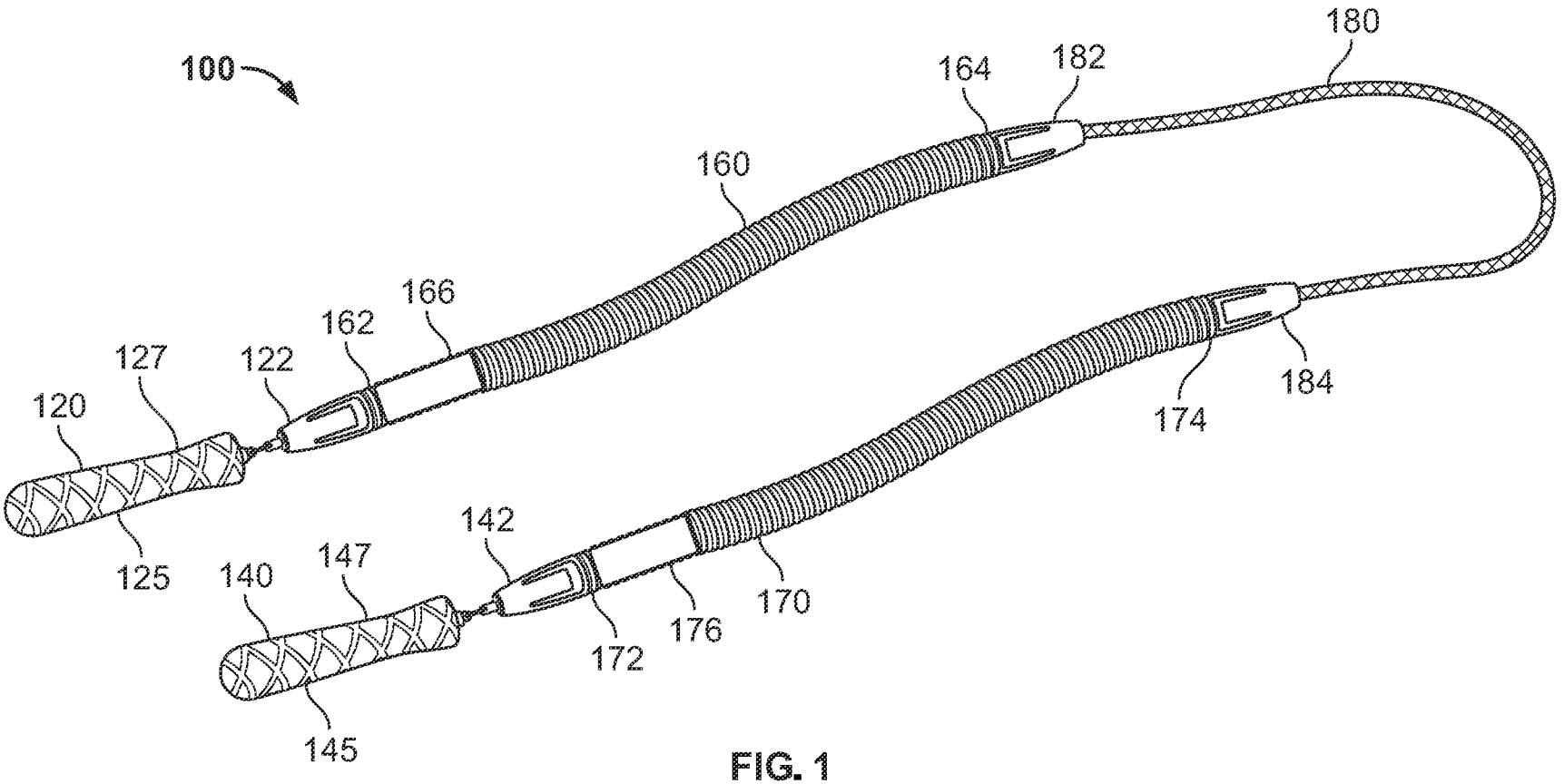
FIG. 1 is a perspective view of an exemplary training device.

The training devices disclosed herein incorporate handles with both elastic and inelastic members. The elastic members may be stretched up to 2.5× their neutral length before their stretch limit is reached such that the respective elastic members cannot be lengthened further without failure. The speed at which the elastic members first begin to elongate defines their elastic threshold. A user can perform exercises using the training devices disclosed herein inside or outside of the elastic threshold. For example, a user may perform an exercise at slow speed where the elastic members are not induced into lengthening and then increase speed to perform within the elastic threshold. The user may also increase the speed of use so as to reach and/or exceed the elastic threshold thereby elongating the elastic members to their limit lengths while engaging in vigorous exercise. The constant recoil forces generated by the elastic members against the centrifugal forces at speeds that reach and/or exceed the elastic threshold provides the user with moment to moment instantaneous feedback. This aids in both motivation and sensory experience useful for developing precise coordination to operate the device at such intensity for a more effective training stimulus. Further, the incorporation of both elastic and inelastic members in a single training device provides unique training stimulus for the user.

During use, the user must swing the training device with sufficient speed to maintain a lengthening of the elastic members, which will return to their neutral length when not enough tension is present. The tendency of each elastic member is therefore to return to its neutral length under insufficient tension. Elongation of each elastic member of the training device is a function of the resistance of each member and the speed at which it is travelling. Depending on the resistance or modulus of elasticity of a particular elastic member, the user must maintain a certain speed to maintain elongation of the elastic member and to perform his or her workout within and/or outside the above described elastic threshold.

The training devices may be provided in the form of a kit including multiple interchangeable components such that various handles, elastic and inelastic members may be included in the kit. Each of the elastic members may include both elastic and inelastic portions. The training stimulus (amount of speed/force) for each training device disclosed herein can be calibrated based on the modulus of elasticity of the elastic members utilized in the kit, the location of the inelastic portions of each of the elastic members in relation to a respective handle and inelastic member, and the length and/or weight of each of the elastic and inelastic members, for example. Each movement pattern in combination with the various features of the training devices disclosed herein will produce a different centripetal/centrifugal force based on the type of workout the user desires. This provides the user with a dynamic range of fitness and exercise capability in their workout routines using the training devices disclosed herein. The training devices disclosed herein can be used by a user at any time with or without handles and with both of their hands or either their left or right hands alone. This provides additional variability to users of these training devices.

Further, a user can perform exercises whereby he or she targets different elongation lengths during a given movement pattern. In one example of using a training device, the user can hold the device with both or either hand and rotate the device with enough speed to hit external targets (spots on the floor for example) with increasing distance from the standing position of the user. The elongation capability of the training device may therefore be used strategically to improve coordination and strength compared to a rope without these unique properties.

In some embodiments, elastic members and an inelastic member with certain properties are chosen to match the abilities of the user depending upon their particular training objectives. For example, a shorter and lighter inelastic member may require the user to exert greater force/speed to elongate one or both of the elastic members. A user can begin training with a longer and/or heavier inelastic member to learn patterns and progress to more challenging arrangements whereby the inelastic member is replaced by one of differing material/weight/size/length etc.

The elasticity of the elastic members provides immediate feedback to the user such that they can alter movement patterns to target different muscles of the body or to regulate cardiovascular exertion. The elasticity of the elastic members and the feedback provided thereby requires a unique type of exertion by the user. Particularly, the user's efforts to cause the training device to elongate by swinging the training device will cause the momentum, air resistance, and resilience of the elastic members to be experienced as resistance by the user. This type of feedback is particularly useful for training whole-body coordination, as one side of the body may lead the other. The user may, for example, attempt to trace a symmetrical pattern while swinging the device, in which case the user's dominant side will, in effect, teach the user's non-dominant side as the non-dominant side attempts to keep up with and reproduce the dominant side's motion. If enough repetitions are completed, this may lead not only to cardiovascular improvements or muscle generation, but also an increase in muscle memory, which leads to a virtuous cycle of fitness training. The training of the non-dominant side is also facilitated by the modular nature of the training device.

Differing elastic members can be selected from the system or kit to produce an asymmetric training device. For example, one of the elastic members used may have a different modulus of elasticity, weight, or length than the other of the elastic members. Further, the inelastic portion of one elastic member may vary from the inelastic portion of another elastic member. This will lead to differing air resistance and elongation of each elastic member which will provide the user with an ability to even out non-dominant muscles on one side of the body or strengthen weak areas. The user can thus configure the device to apply greater, lesser, or simply different resistance and feedback to the user's non-dominant side, compared to the user's dominant side, as desired.

In one embodiment, shown in FIG. 1, a training device 100 comprises a first handle 120, a second handle 140, a first elastic member 160, a second elastic member 170 and an intermediate member or center member 180. In the illustrated example, elastic members 160, 170 are substantially elastic, while the intermediate member 180 is substantially inelastic. The intermediate member 180 therefore has little or no appreciable elasticity, and any elasticity the intermediate member 180 might have is significantly less than the elasticity of elastic members 160, 170.

In the illustrated example, the first elastic member 160 includes a first inelastic segment or portion 166 and the second elastic member 170 includes a second inelastic segment or portion 176. The inelastic segments 166, 176 may be constructed of, for example, a band of woven natural and/or synthetic fibers. In the present example, the inelastic segments 166, 176 are located proximate respective handles 120, 140. In other configurations, first and second inelastic segments 166, 176 of elastic members 160, 170 may be located proximate opposing ends of intermediate member 180. In yet other configurations, either one of the elastic segments may be located proximate handles 120, 140 and the other of the elastic segments may be located proximate one of opposing ends of intermediate member 180. In yet other configurations, inelastic segments 166, 176 may be located at any point along the respective lengths of first and second elastic members 160, 170.

In other examples, inelastic segments 166, 176 may be wider or narrower, longer or shorter, and thicker or thinner to increase or decrease the air resistance and/or weight thereof. Because elastic members 160, 170 of the illustrated example each include a respective inelastic segment 166, 176, reference to the elasticity of the elastic members 160, 170 herein refers to the elasticity of the elastic members 160, 170 overall.

The first and second handles 120, 140 are elongate and have respective connector portions 122, 142 that are rotatably coupled thereto. This allows a user to hold each handle 120, 140 firmly while connector portions 122, 142 can swivel with respect to handles 120, 140 during use. The first and second handles 120, 140 each have a respective ergonomic gripping portion 125, 145 and an end portion 127, 147 coupled to the respective connection portion 122, 124 which are also coupled to the respective one of the opposing ends of the first and second members 160, 170.

First elastic and second members 160, 170 can therefore rotate with respect to handles 120, 140 via rotatable connector portions 122, 124 thereof. First elastic member 160 has opposing ends 162, 164, one of the opposing ends of the first member 160 coupled to the first handle 120. Second elastic member 170 has opposing ends 172, 174, one of the opposing ends of the second member 170 coupled to the second handle 140. Intermediate member 180 has opposing ends 182, 184, a first of the opposing ends of the intermediate member 180 coupled to the first member 160 and a second of the opposing ends of the intermediate member 180 coupled to the second member 170.

First and second members 160, 170 have a neutral length between six and twenty four inches. First and second members 160, 170 are stretchable cords, bands or bungee-style members that have a neutral length and an extended length. The extended length of the first and second members 160, 170 is greater than the neutral length. The intermediate member 180 is substantially inelastic. The intermediate member 180 has a length between six and forty inches.

Intermediate member 180 may include additional soft weights/mass as a means to increase the centripetal/centrifugal force exerted upon elastic members 160, 170. In other examples, the intermediate member 180 may be a flexible tube filled entirely or partially with water, a ball, cordage, or a flat band to provide additional air resistance when the device is swung through the air.

Any of the foregoing elastic members, 160, 170 or intermediate members 180 may include a whistle or other noise producing device adapted to make a sound at a pitch that varies along with the speed at which the user swings the exercise device.

Figure 2:
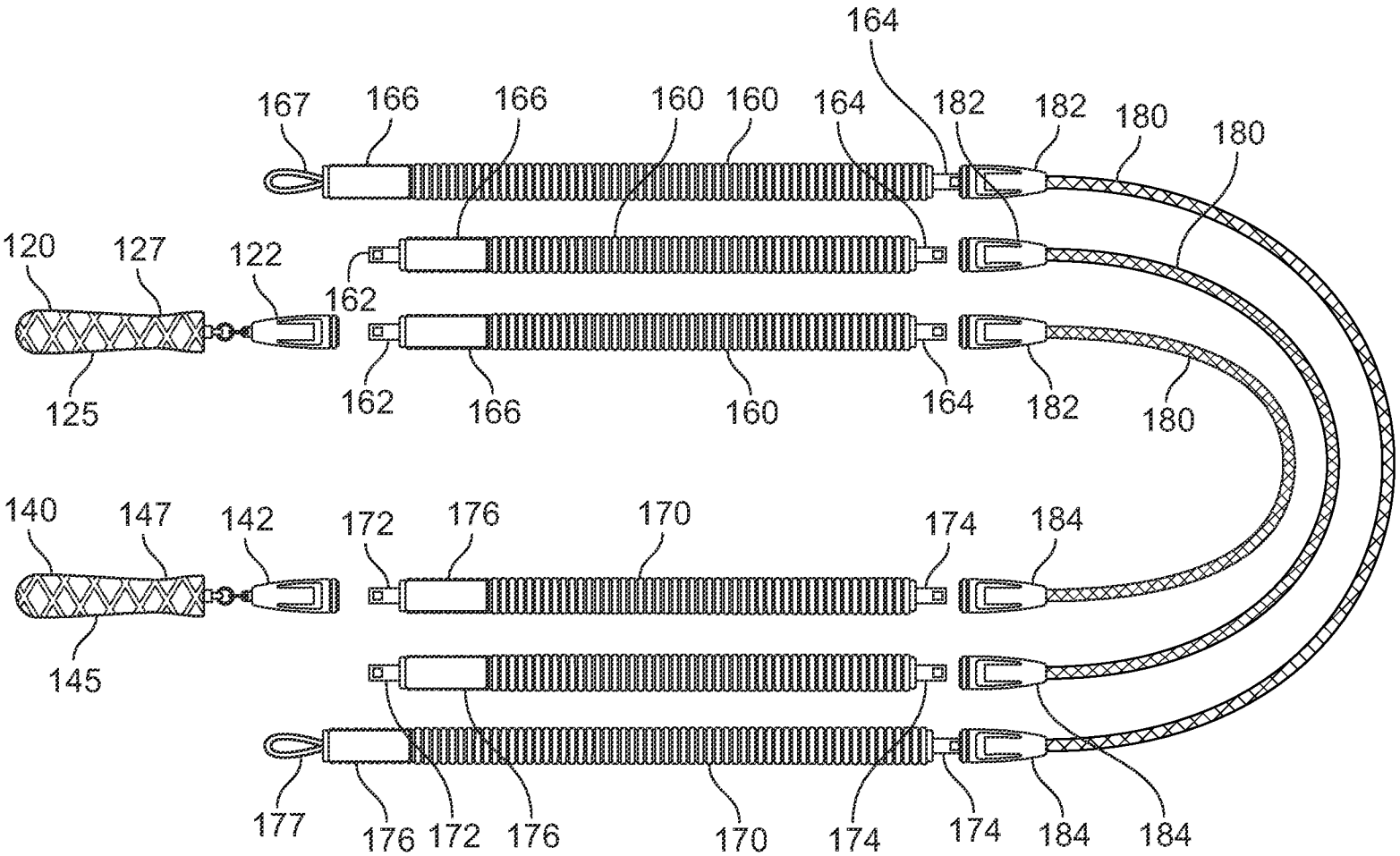
FIG. 2 is a system or kit of parts that may be used to configure the training device of FIG. 1.

As shown in FIG. 2, training device 100 may be provided in the form of a kit comprising multiple first elastic and second members 160, 170 of differing lengths, elasticities, or both. Three different lengths of first elastic and second members 160, 170 are pictured, though more or fewer pairs of first elastic and second members 160, 170 may be included in a kit. Such lengths may be, for example, from six to twenty-four inches or less than six inches or greater than twenty-four inches. Multiple pairs of first elastic and second members 160, 170 may also be provided in varying or equal lengths and different elasticities. Different pairs of first elastic and second members may be provided with elasticities varying by, for example, 10%, 25%, 50% or 100% or approximations of any of those values, from one another.

In addition, or in the alternative, inelastic intermediate members 180 may also be provided in multiple lengths, as shown, in a kit. Such lengths may be, for example, from six to forty inches or less than six inches or greater than forty inches. Though not illustrated, multiple handles 120, 140 of differing shapes and sizes may be provided as well.

Elastic members 160, 170 and intermediate members 180 provided within the kit may also have varying shapes to those shown in the illustrated example. Elastic members 160, 170 and/or intermediate members 180 may be provided having the shape of a substantially flat band, possibly tapered or in a variety of widths, spanning, for example, one to five inches across, or approximations of any of those widths. Such wide bands catch the air as they travel, adding resistance to any exercise that involves swinging training device 100 and enabling such exercises to elongate elastic members 160, 170 and provide resistance to the user at relatively low speeds.

Though illustrated in FIG. 2 as visibly differing only in length, the multiple elastic members 160, 170 and/or intermediate members 180 included in a kit may also or alternatively differ from one another in width or thickness. Generally, the kit may include any of the alternative configurations for the handles, elastic members, or intermediate members described anywhere within this disclosure, in addition to or in the alternative to those illustrated in FIG. 2. In alternative arrangements, however, elastic members 160, 170 and/or intermediate members 180 may be provided that are round or generally cylindrical in shape along some or all of their length.

In the illustrated example, one first elastic member 160 is provided with a first strap or loop 167 instead of tab 162 and one second elastic member 170 is provided with a second strap or loop 177 instead of tab 172. Loops 167, 177 exist in addition to or instead of any features for connecting to handles 120, 140, and may be grasped by a user instead of handles 120, 140. Loops 167, 177 may be elastic or inelastic, and may be straps or cordage. In various arrangements, the kit might include no elastic members 160, 170 with loops 167, 177, or may include only elastic members 160, 170 with loops 167, 177, or may include a combination of elastic members 160, 170 with and without loops 167, 177.

The kit thus enables configuration of the device 100 generally in five independent regions. One such independent region is occupied by the intermediate member 180, with the handles 120, 140 each occupying another respective one of the independent regions, and each of the elastic members 160, 170 occupying another respective one of the independent regions. The handles may differ from the handles 120, 140 illustrated, and the elastic members 160, 170 may be replaced by different elastic members, or even inelastic members, jointly or individually. Thus, the overall nature of exercise enabled by the device 100 may be a result of properties of a selected intermediate member 180, which itself could be an inelastic rope as illustrated or a fluid filled tube, a ball, a weight, an air-catching flat band, or any of a variety of other components, or the omission of an intermediate member 180 altogether, and the feedback provided to or contribution required from either side of the user's body can be varied by selection and configuration of components to occupy the five independent regions. The five regions may be selected and configured independently from one another. The five regions may therefore be arranged asymmetrically to provide different training stimulus to either side of the user's body.

In some particular examples of the above mentioned asymmetry, the elastic members 160, 170 may be selected asymmetrically. For example, a device 100 may be assembled having a first elastic member 160 that differs in elastic resilience, neutral length, or both, from the connected second elastic member 170.

The modularity of the device 100 also enables replacement of worn or damaged parts individually. For example, in a typical jump rope, a center point of the rope will strike or drag across surfaces more frequently than any other portion of the rope during most exercises performed while the user grasps both handles. The center point of a typical jump rope may therefore become frayed or even fail while the handles and the remainder of the rope remain in good condition, nonetheless requiring replacement of the entire jump rope. Thus, the user may just replace intermediate member 180 if this becomes an issue instead of throwing away the entire training device.

Figure 3:
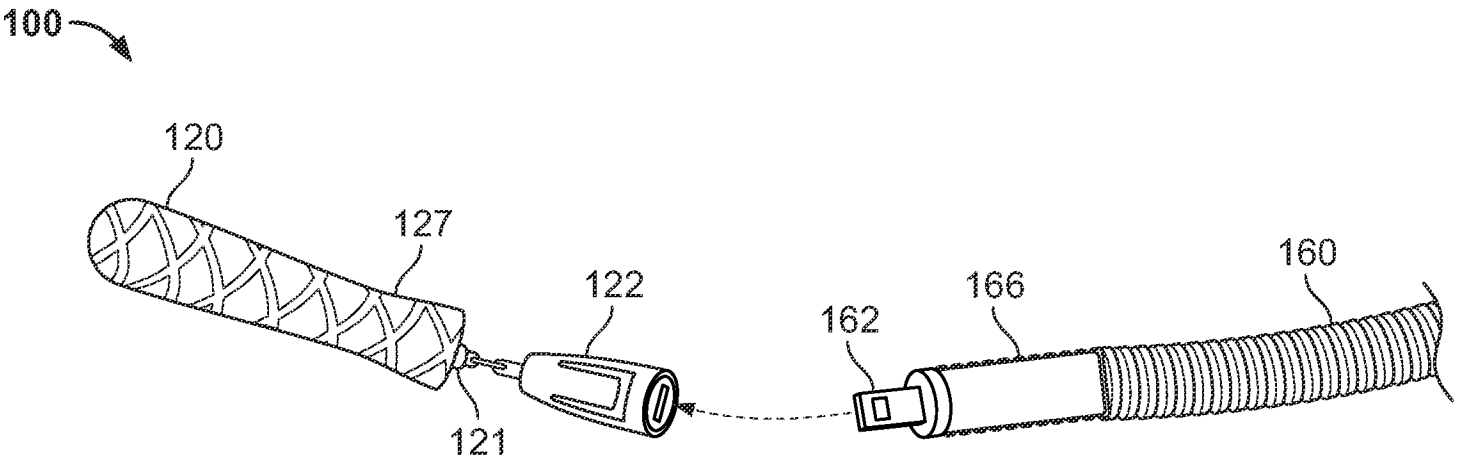
FIG. 3 is a perspective enlarged view of a handle of the training device of FIG. 1.
Figure 4A:
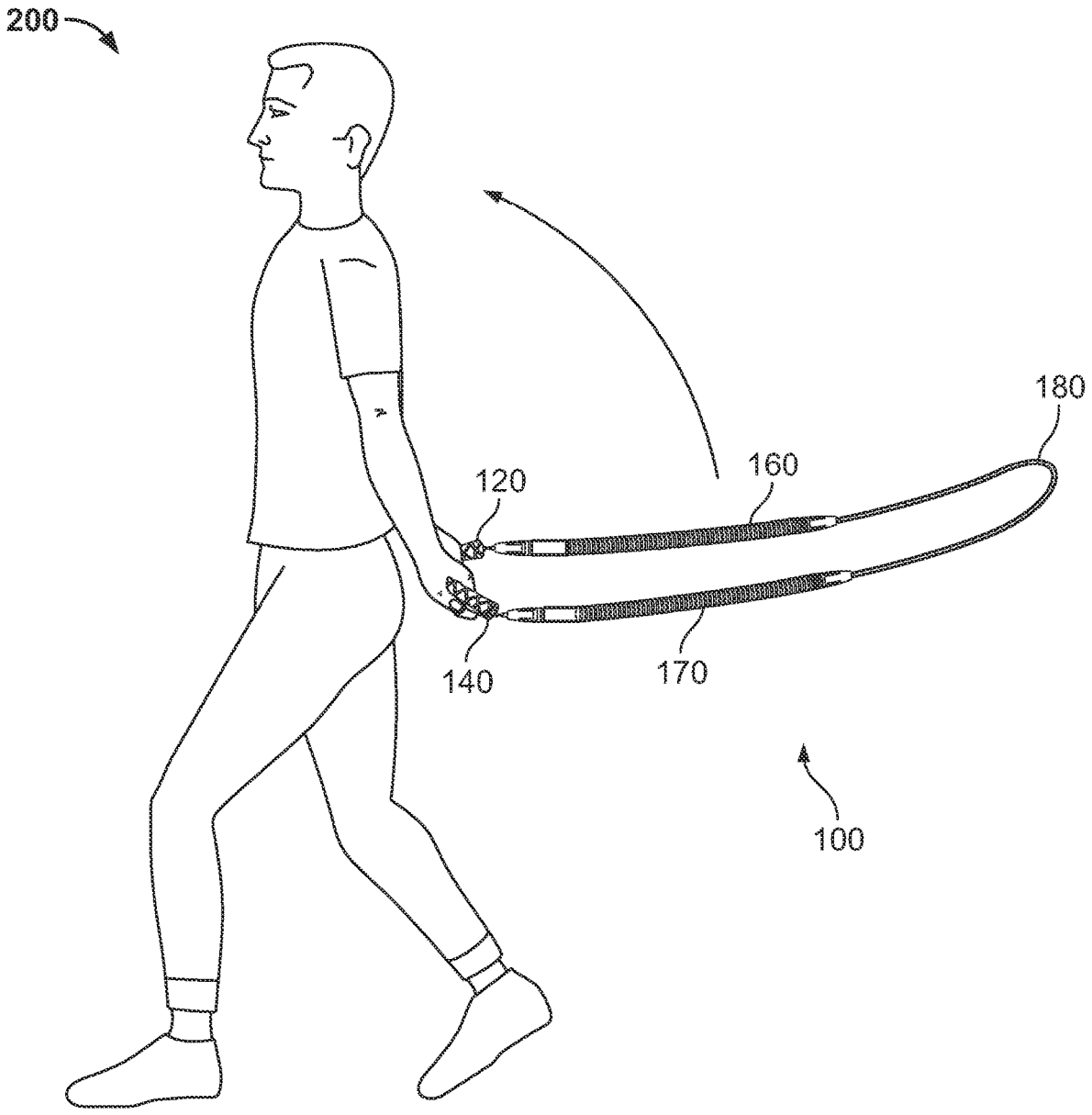
FIGS. 4A-4D illustrate a user jumping over the training device of FIG. 1.
Figure 4B:
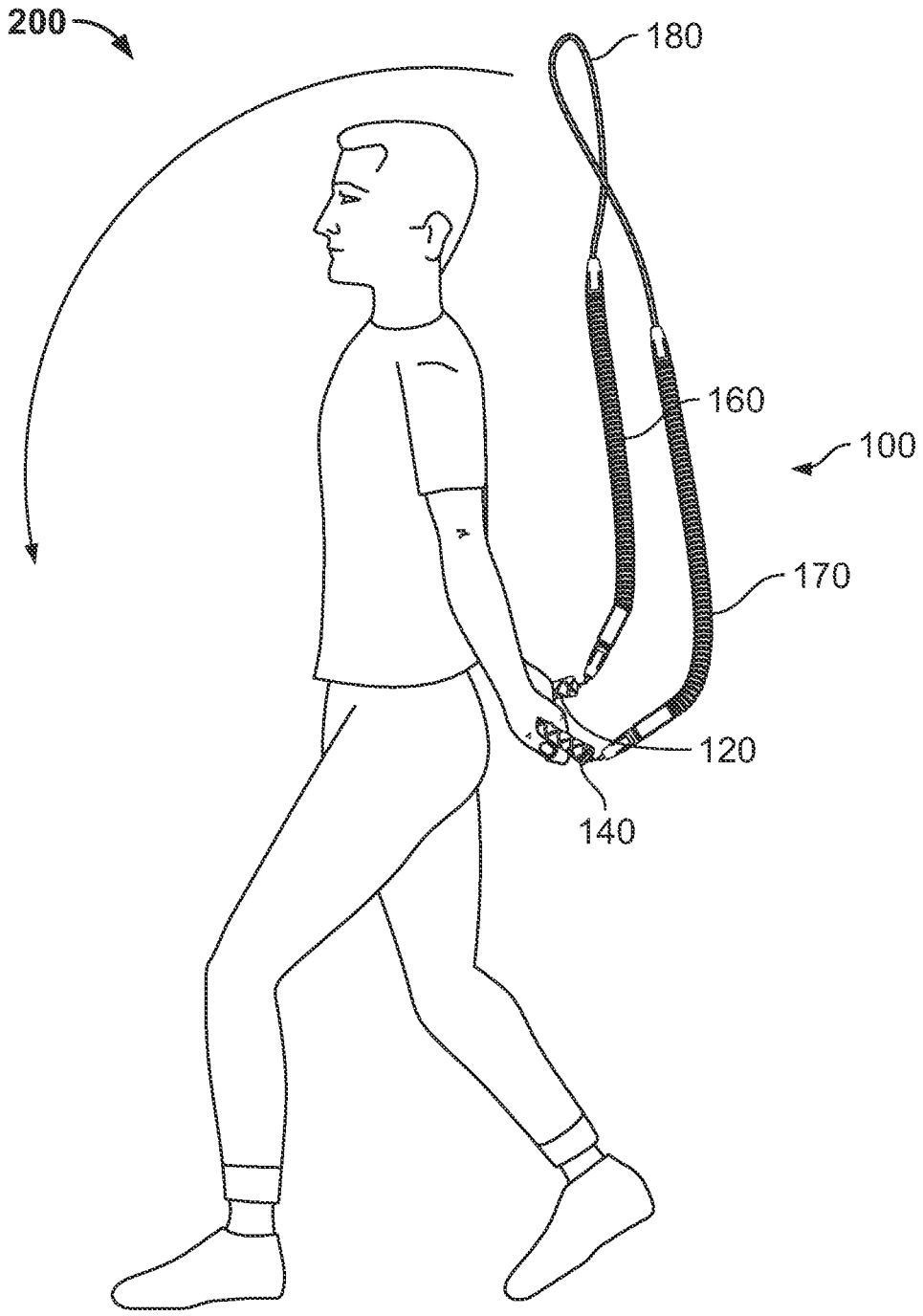
Figure 4C:
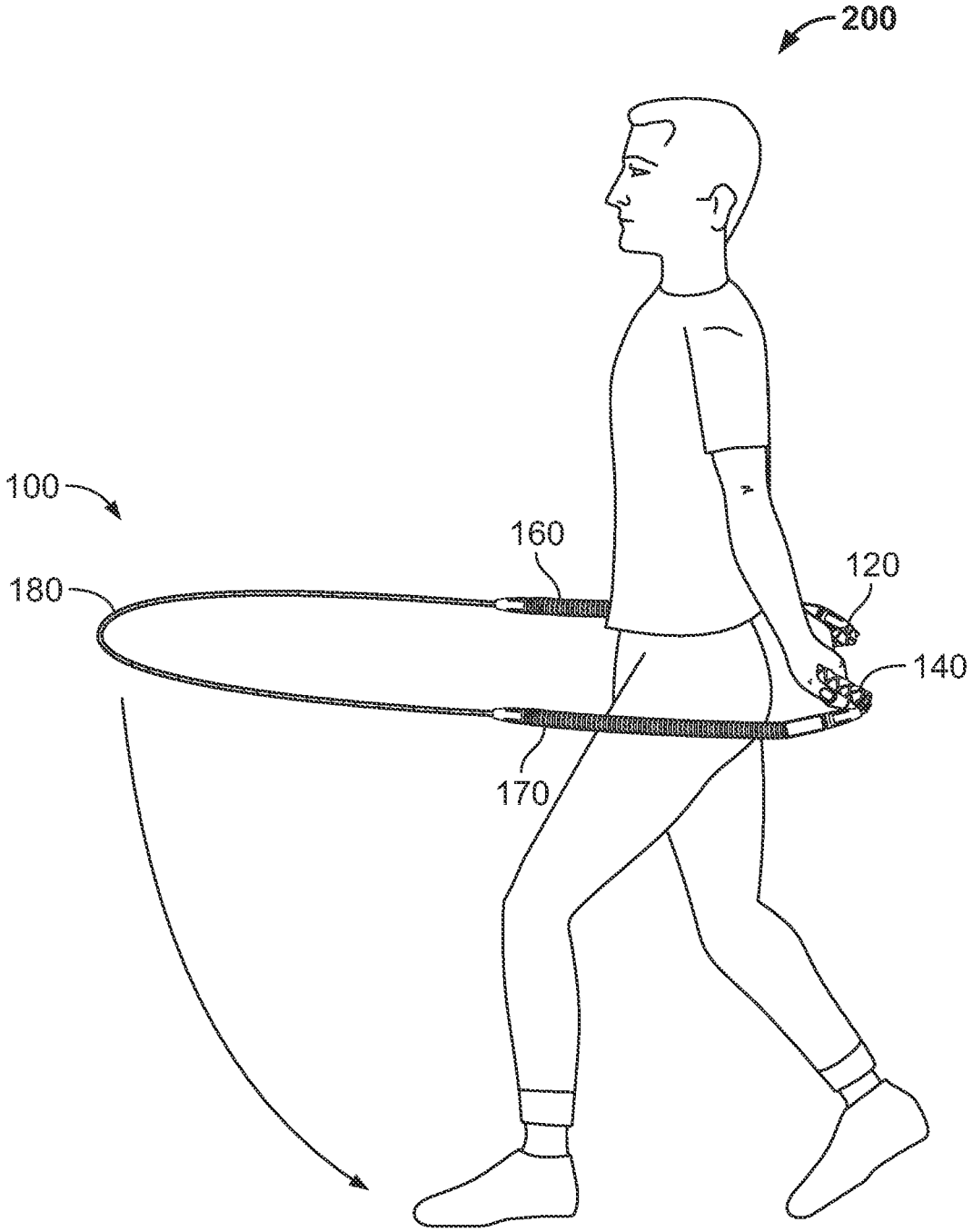
Figure 4D:
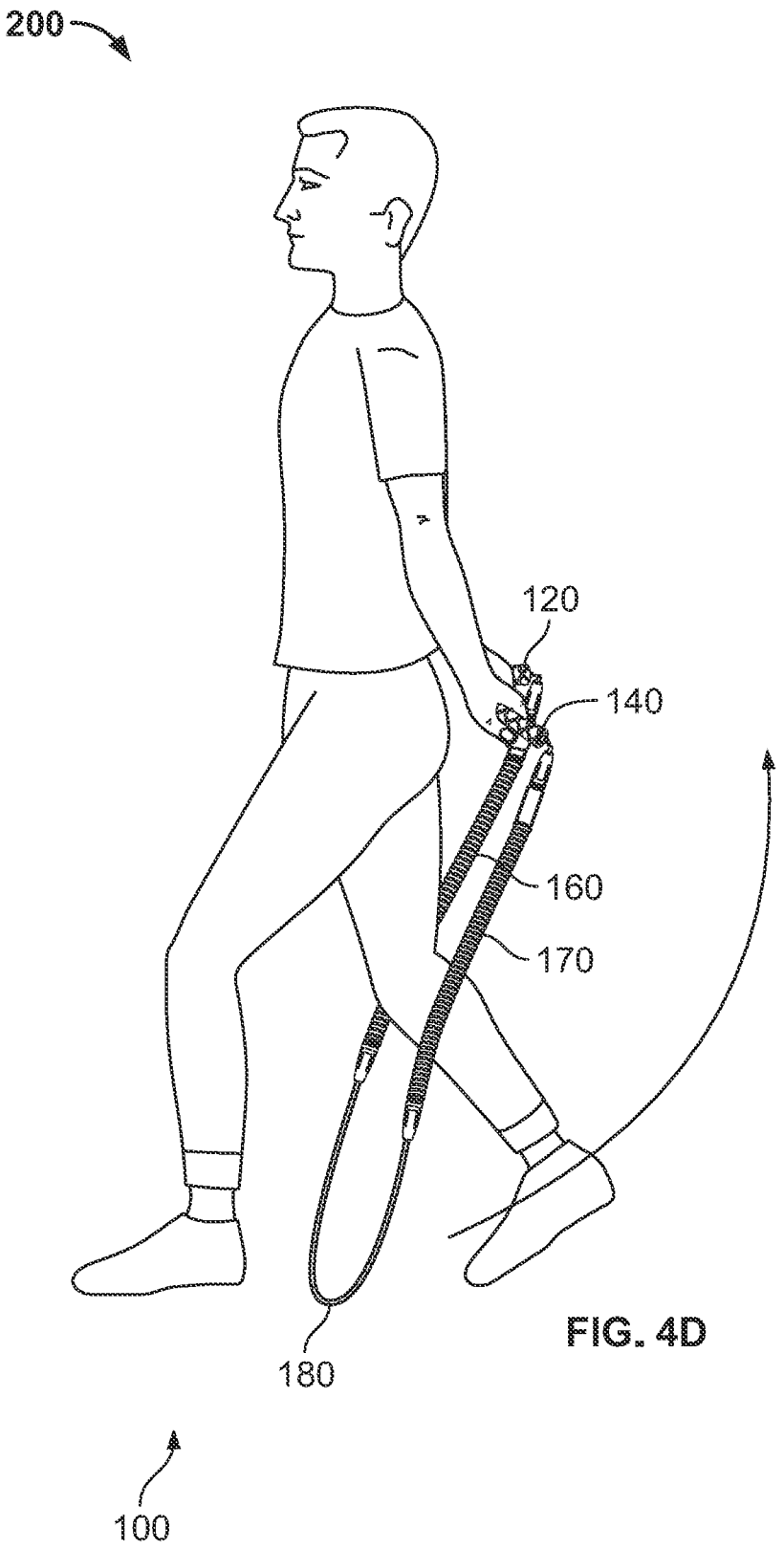
Figure 5A:
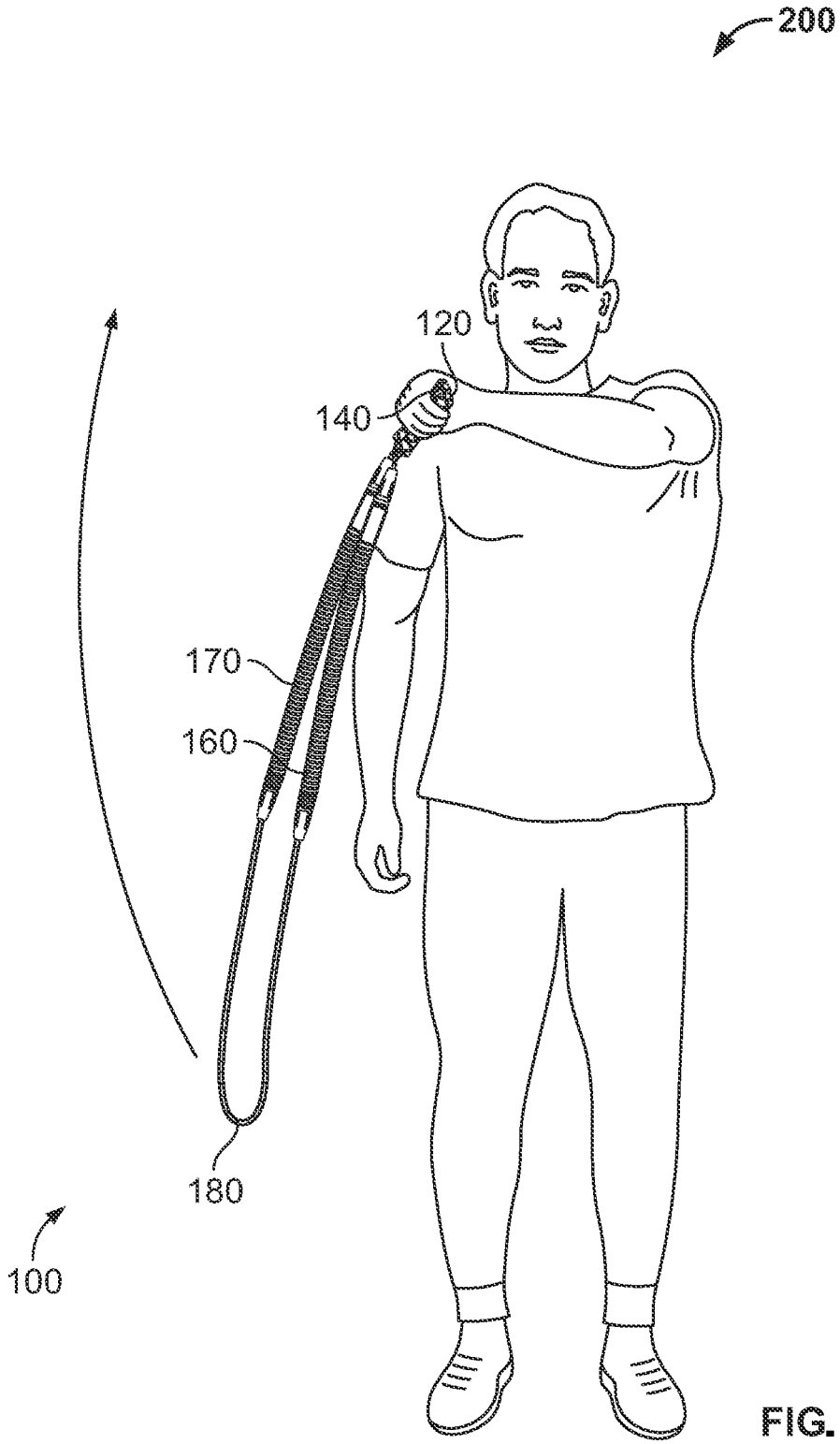
FIGS. 5A-5D illustrate a user performing a first swinging exercise with the training device of FIG. 1.
Figure 5B:
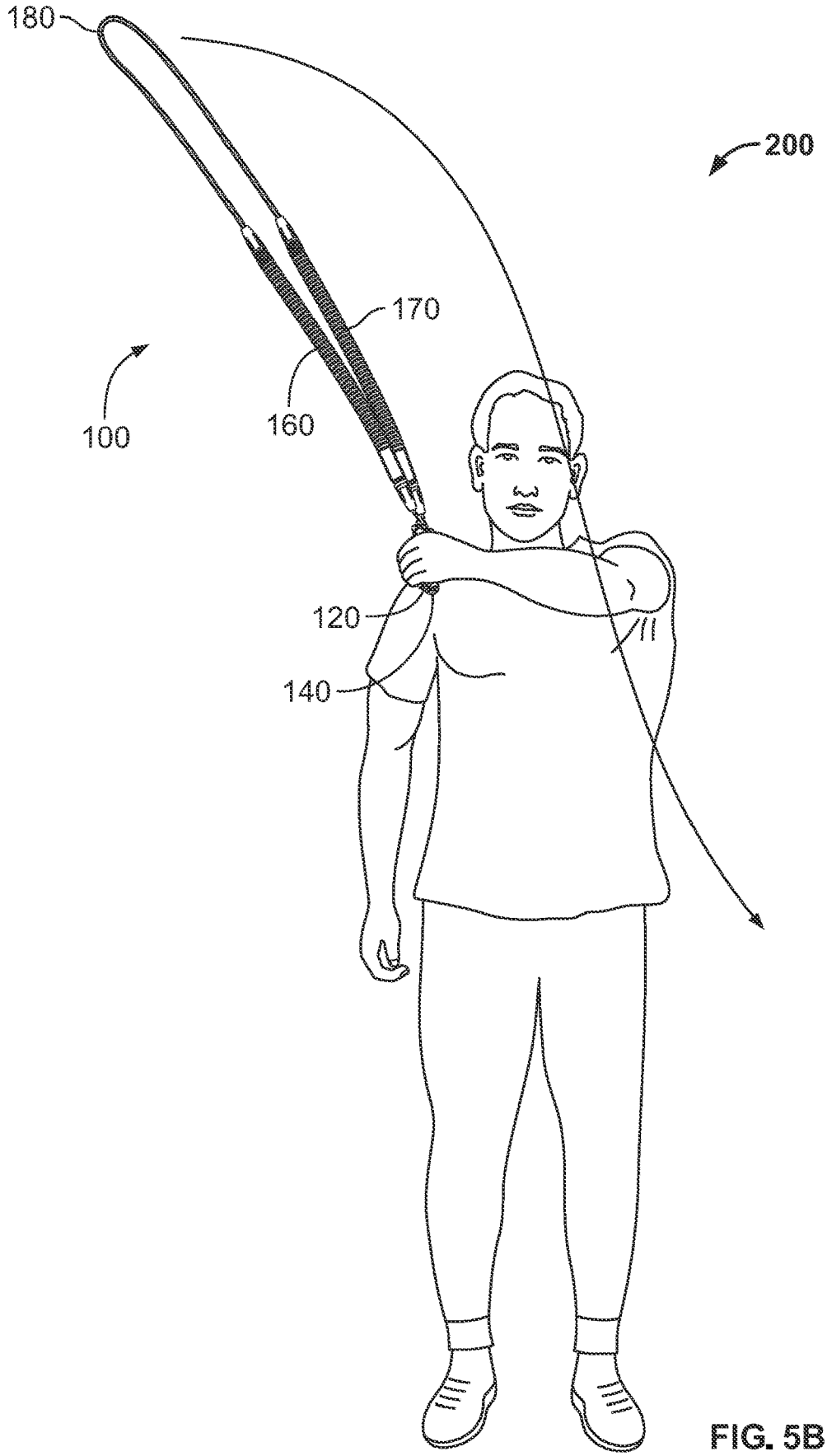
Figure 5C:
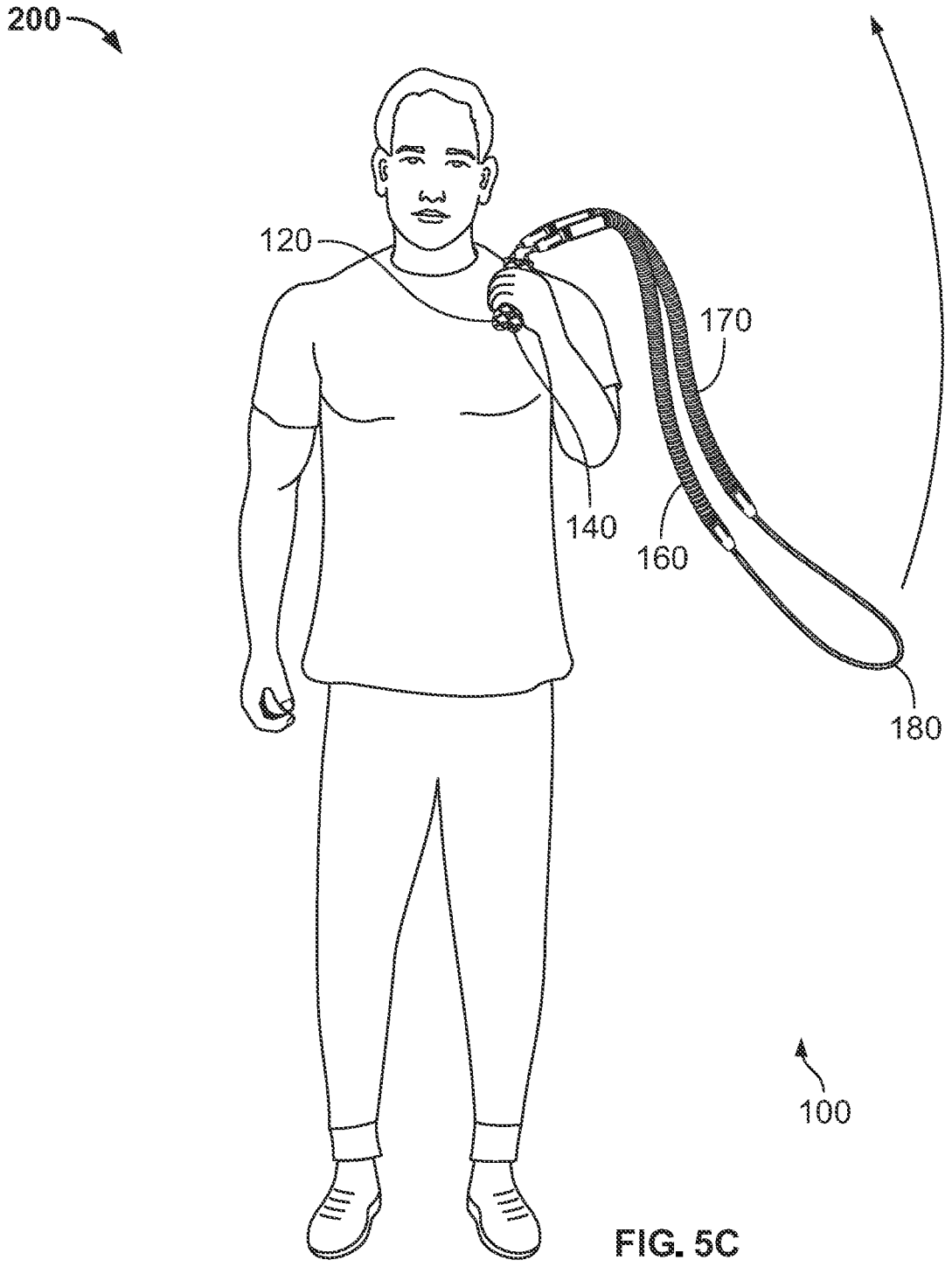
Figure 5D:
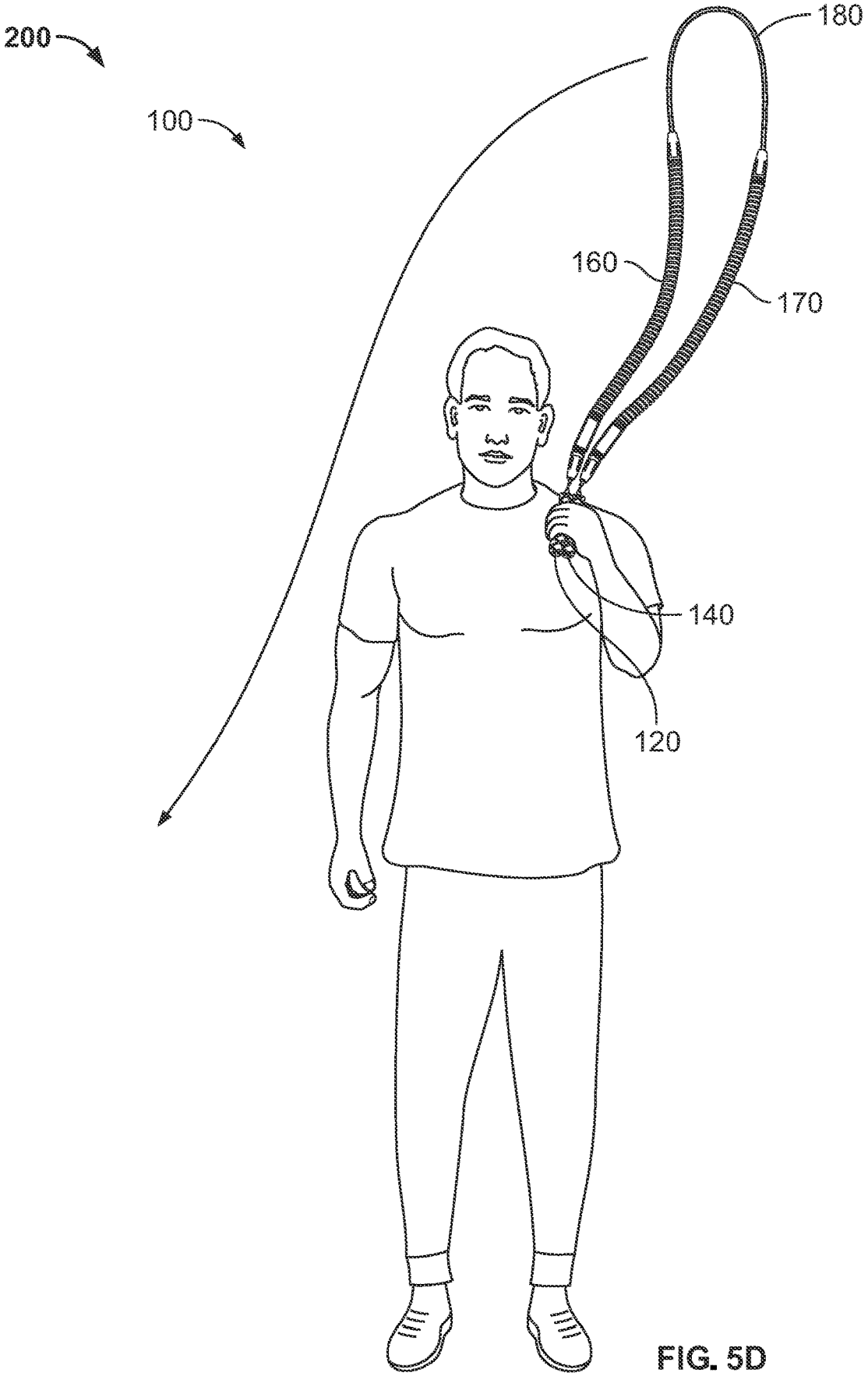
Figure 6A:
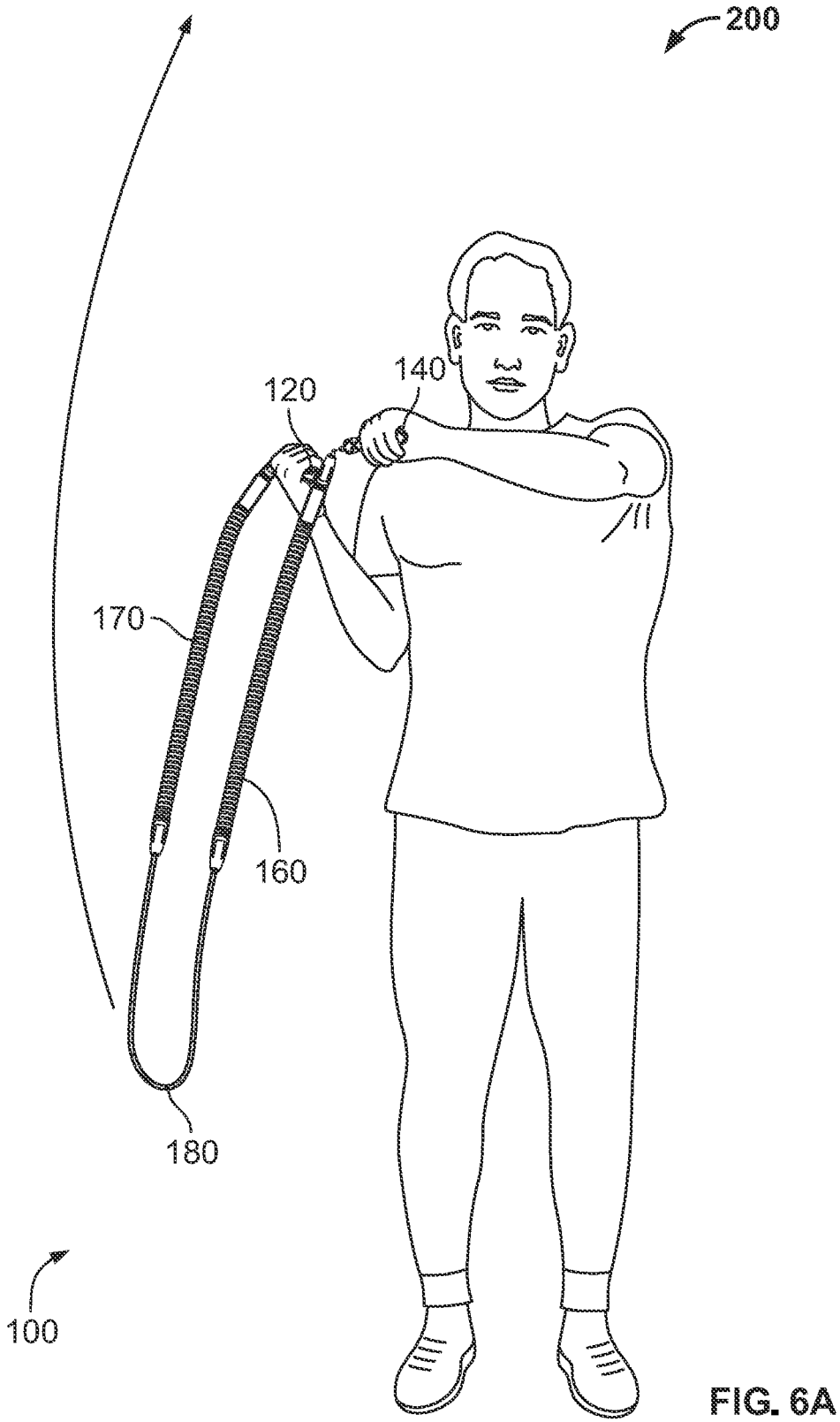
FIGS. 6A-6D illustrate a user performing a second swinging exercise with the training device of FIG. 1.
Figure 6B:
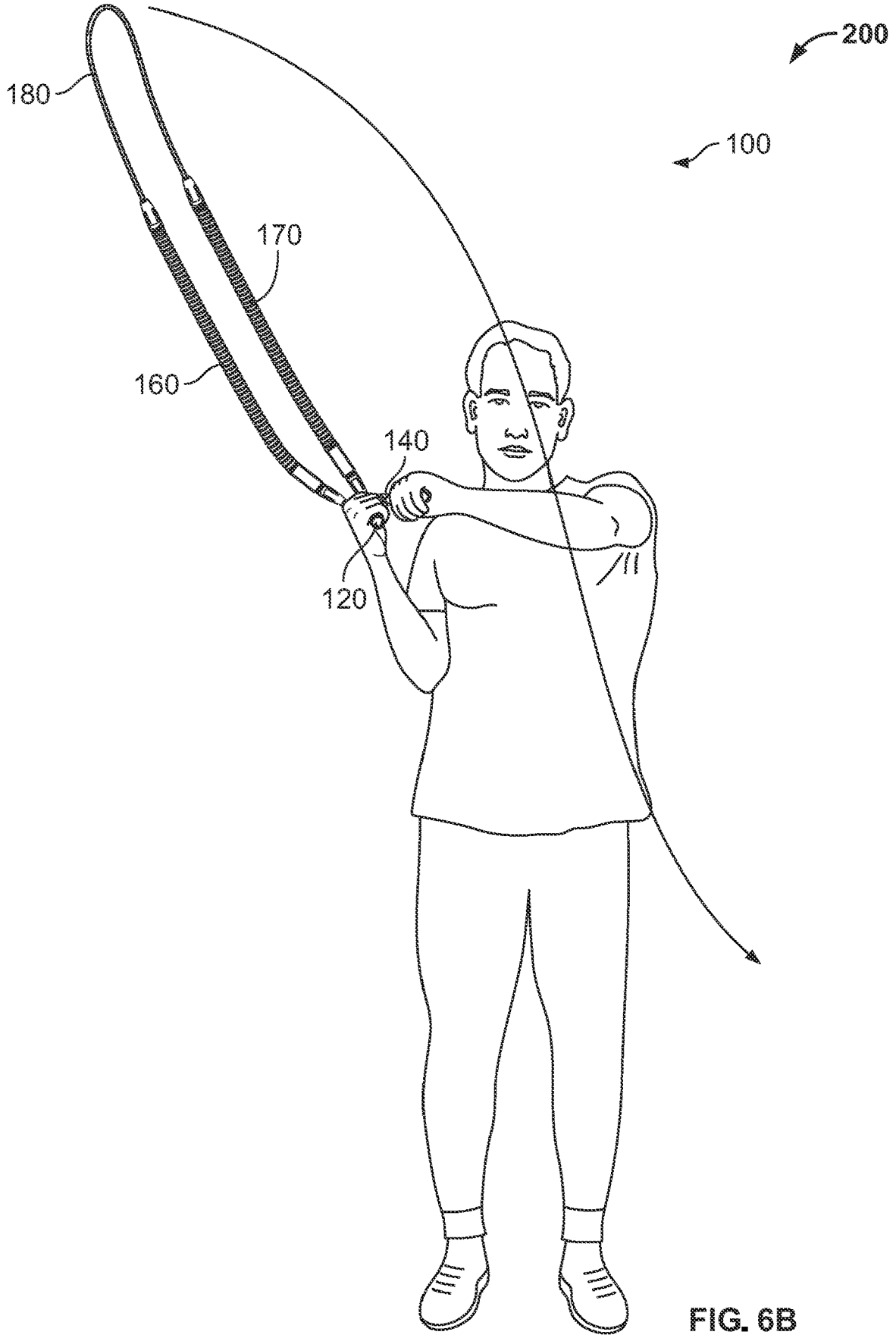
Figure 6C:
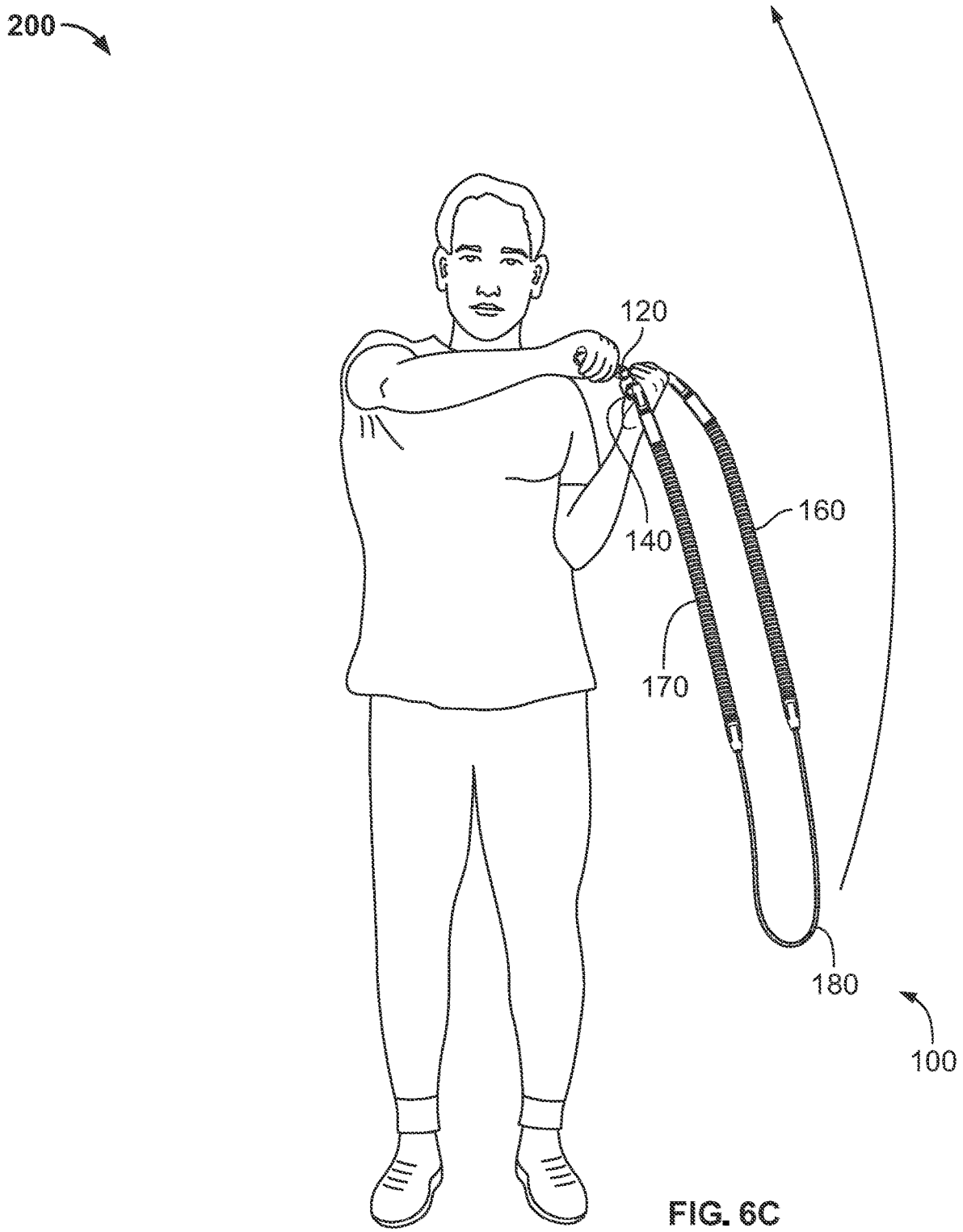
Figure 6D:
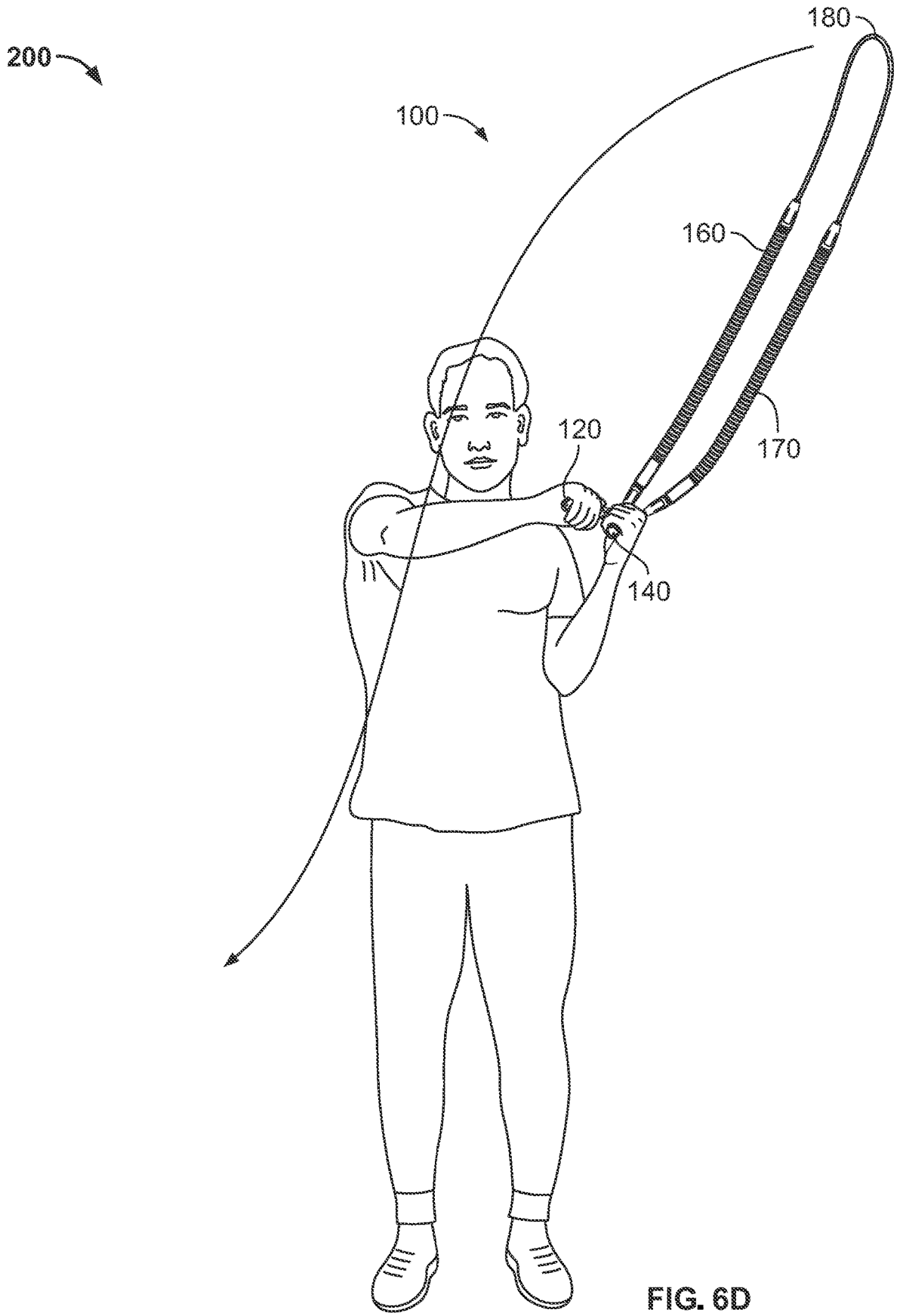
Figure 7A:
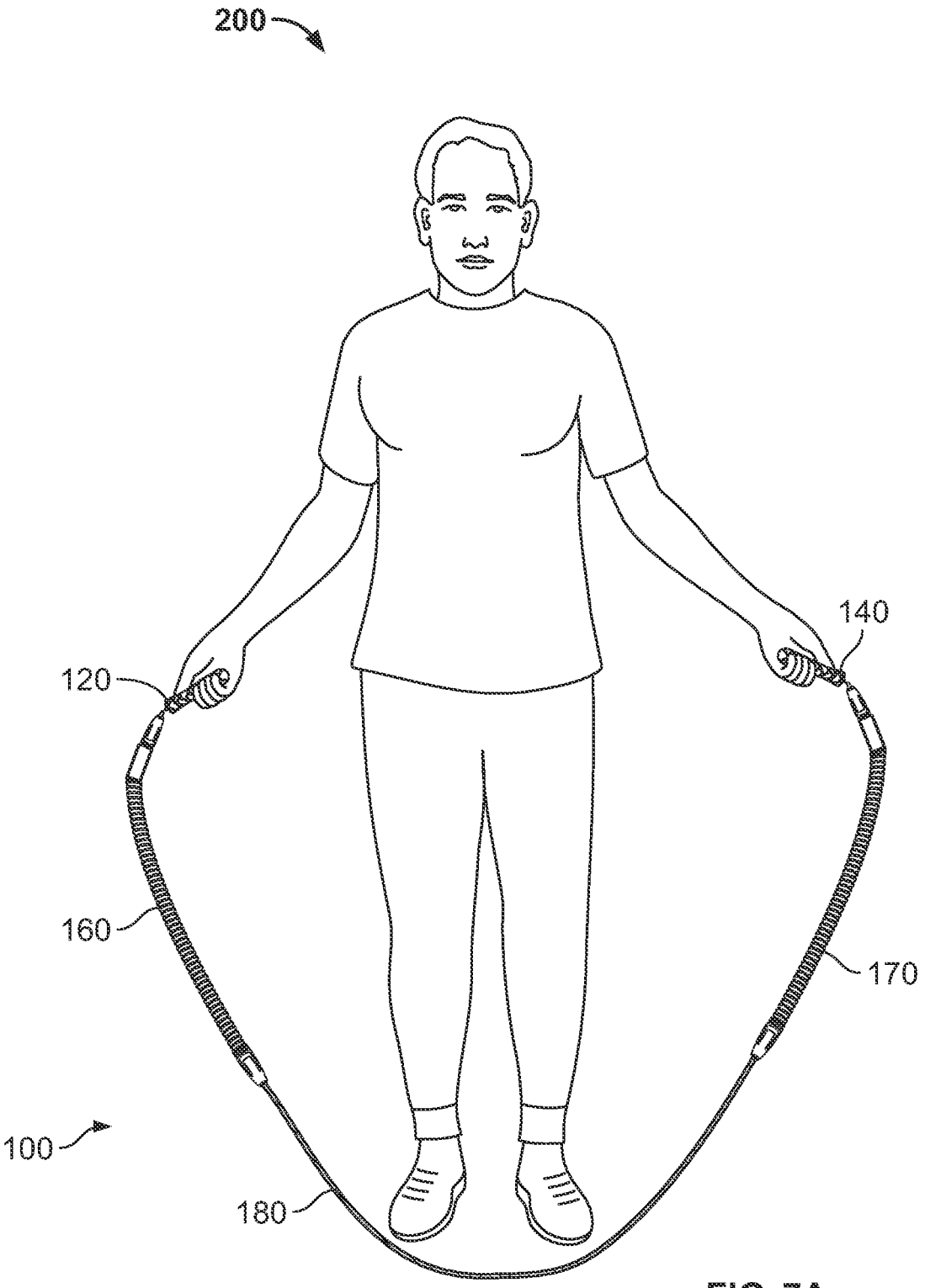
FIGS. 7A-7D illustrate a user performing a third swinging exercise with the training device of FIG. 1.
Figure 7B:
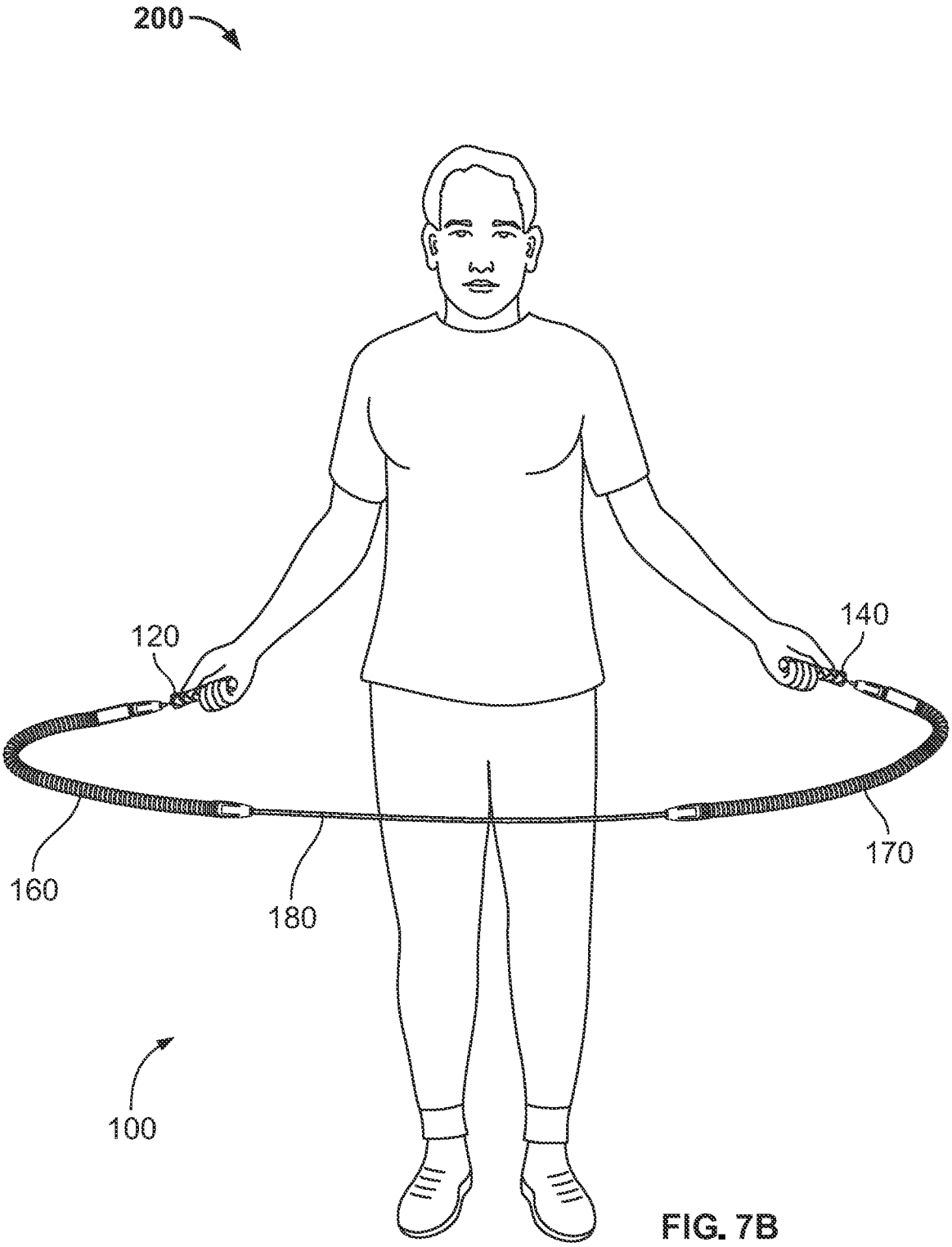
Figure 7C:
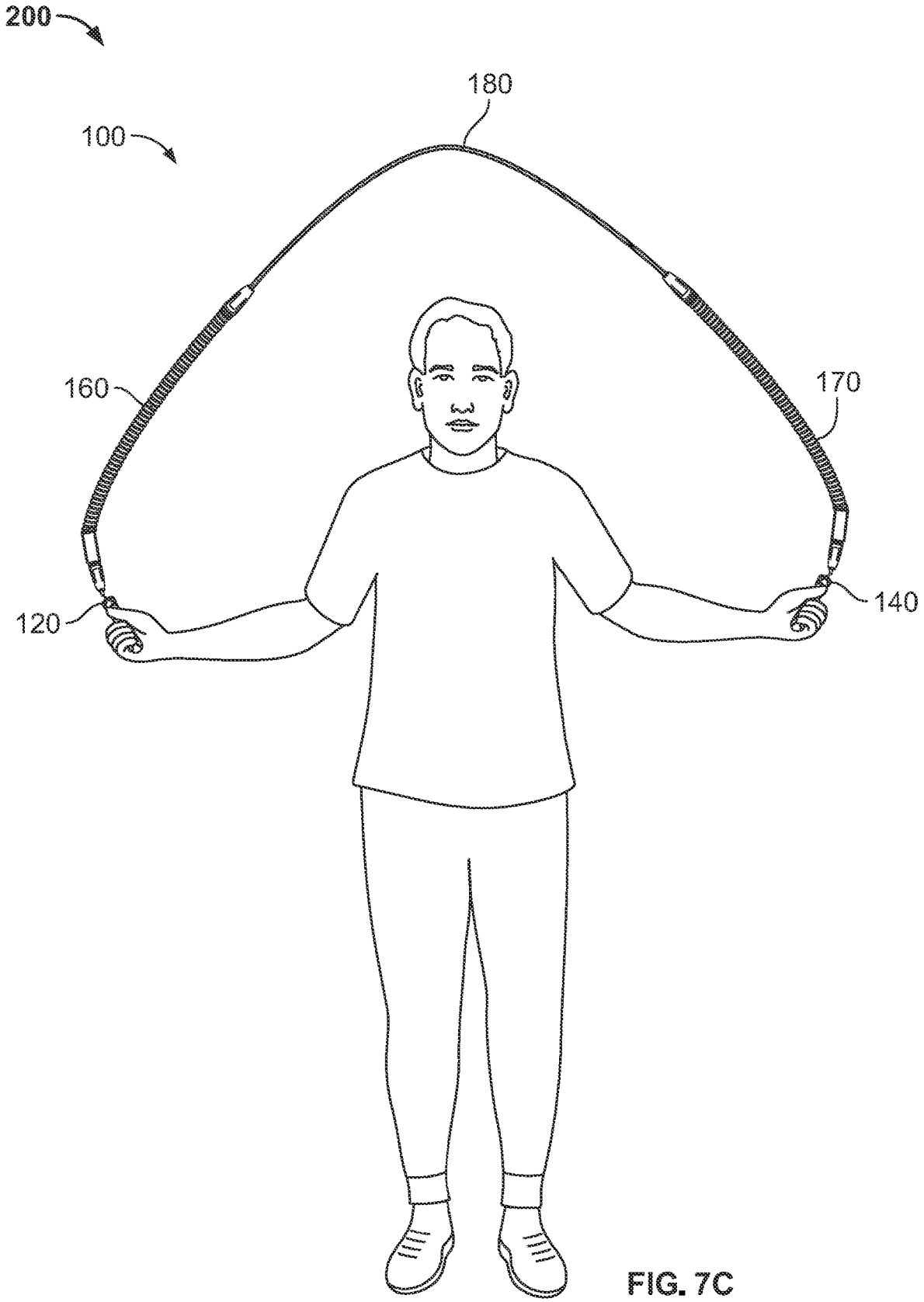
Figure 7D:
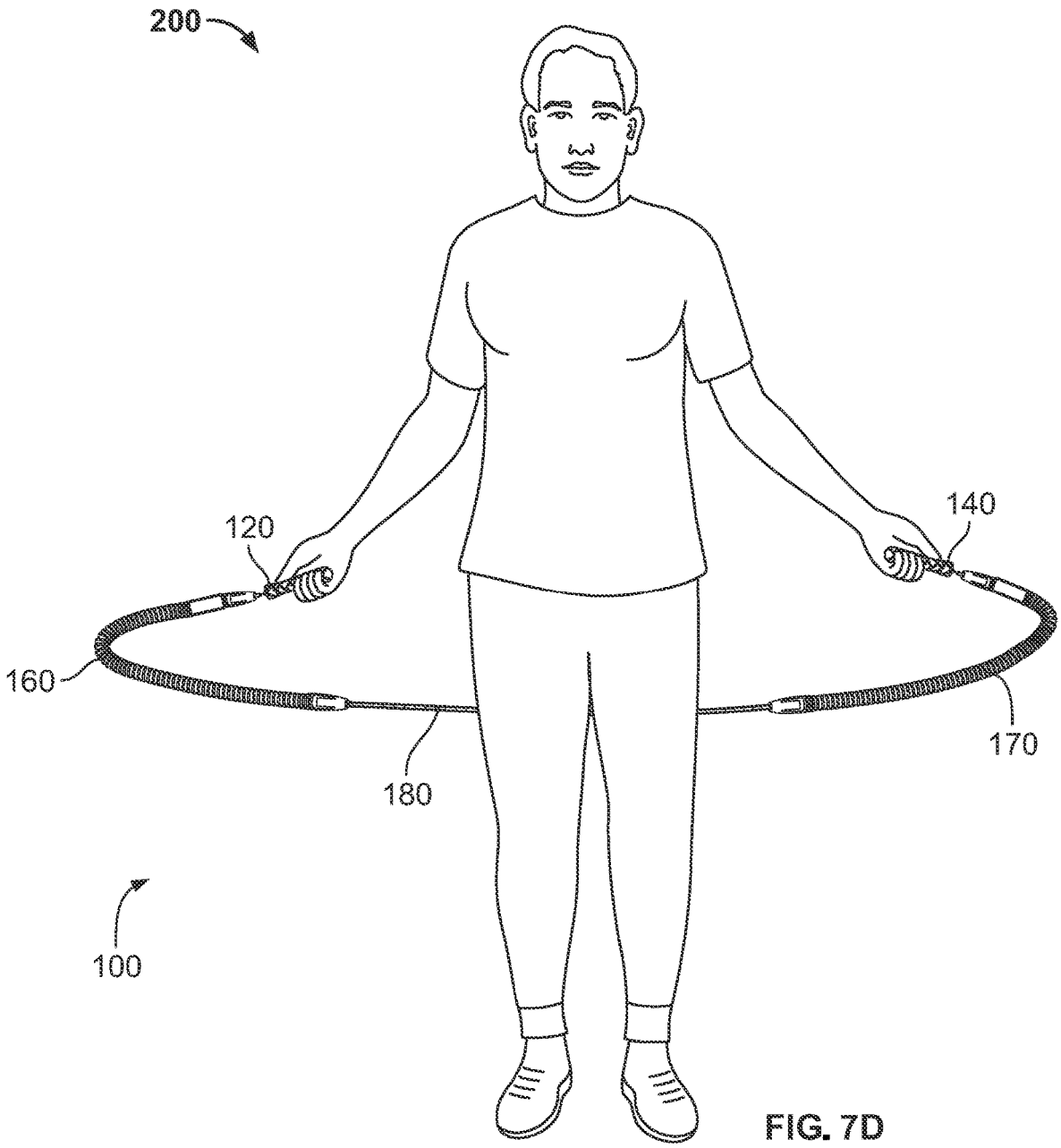

Turning to FIG. 3, handle 120 may be attachable to first elastic member 160 by, for example, a resilient buckle mechanism. In the illustrated example, the end 122 of the first handle 120 is an accepting portion of the resilient buckle mechanism. The end 122 is connected to a ring, which is itself connected to a swiveling post 121 extending from the first handle 120. The end 122 is therefore able to swing in any manner relative to the first handle 120. A tab 162 extends from the end of the first elastic member 160, and can be accepted within the end 122. End 122 includes an internal resiliently biased element that is deflected during insertion of the tab 162, and upon full receipt of the tab 162 the biased element snaps back to its rest position to engage an aperture in the tab 162. The biased element within the end 122 thus prevents release of the tab 162 until a button on the end 122 is depressed to move the biased element out of engagement with the aperture of the tab 162. Alternatively, tab 162 may be flexible and may deflect during insertion into end 122 until snapping into place to engage an element internal to end 122. In such an alternative, depressing the button of end 122 bends tab 162 out of engagement to permit release of tab 162 from end 122.

End 122 and tab 162 are respective coupling portions of first handle 120 and first elastic member 160. End 142 of second handle 140 may be connectable to first end 172 of second elastic member 170, and inelastic intermediate member 180 may be connectable to elastic members 160, 170, with similar or identical mechanisms to those illustrated and described with regard to end 122 and tab 162. In alternative arrangements, ends 122, 142 of handles 120, 140 may be tabs while first ends 162, 172 of elastic members 160, 170 are receiving portions of respective resilient buckle mechanisms. The resilient buckle mechanism illustrated is only one example, and handles 120, elastic members 160, 170, and intermediate member 180 may be interconnectable with any other suitable mechanism.

Returning to FIG. 1, both ends 162, 164 of the first elastic member 160 are the same, as are both ends 172, 174 of the second elastic member 170. The elastic members 160, 170 are therefore reversibly connectable, meaning the inelastic segments 166, 176 thereof may be connected nearer or further from the respective handle 120, 140. Other members provided within the kit to occupy the same position as elastic members 160, 170 may be similarly reversible.

Components of the device 100 may house sensors and transmitters to communicate exercise data to an external computing device, such as, for example, a smart phone. Such sensors may be, for example, gyros, inertial measurement units, revolution counters, stress sensors or tension measurement devices, or any combination thereof. The sensors may therefore be used to measure and report the speed, frequency, and force of any motion performed by the user during exercise with the device. The sensors may be enclosed within the handles 120, 140, and in a more specific example, the sensors may be connected to or embedded within the swiveling element (such as swiveling post 121 shown in FIG. 3) of the handles 120, 140 to which the respective ends 122, 144 are connected. The sensors may therefore specifically measure the rotation speed of or stress upon the swiveling element. However, in other examples, the sensors may alternatively or additionally be embedded within any portion of the elastic members 160, 170 and/or the intermediate member 180.

As shown in FIGS. 4A-4D, a user 200 may use training device 100 in a manner similar to a conventional jump rope. User 200 may configure or select training device 100 such that its total length, when at rest, would be too short for user 200 to use as a jump rope. Such configuration would require user 200 to maintain a certain minimum rotational speed of training device 100 to enable user 200 to jump over the rope. User 200 would need to swing training device 100 fast enough that centrifugal force on training device 100 would cause elastic members 160, 170 to stretch enough for user to jump over intermediate member 180. User 200 could vary the necessary swing speed according to user 200's particular goals by choosing different elastic members 160, 170 or intermediate member 180 from the kit.

Figure 8:
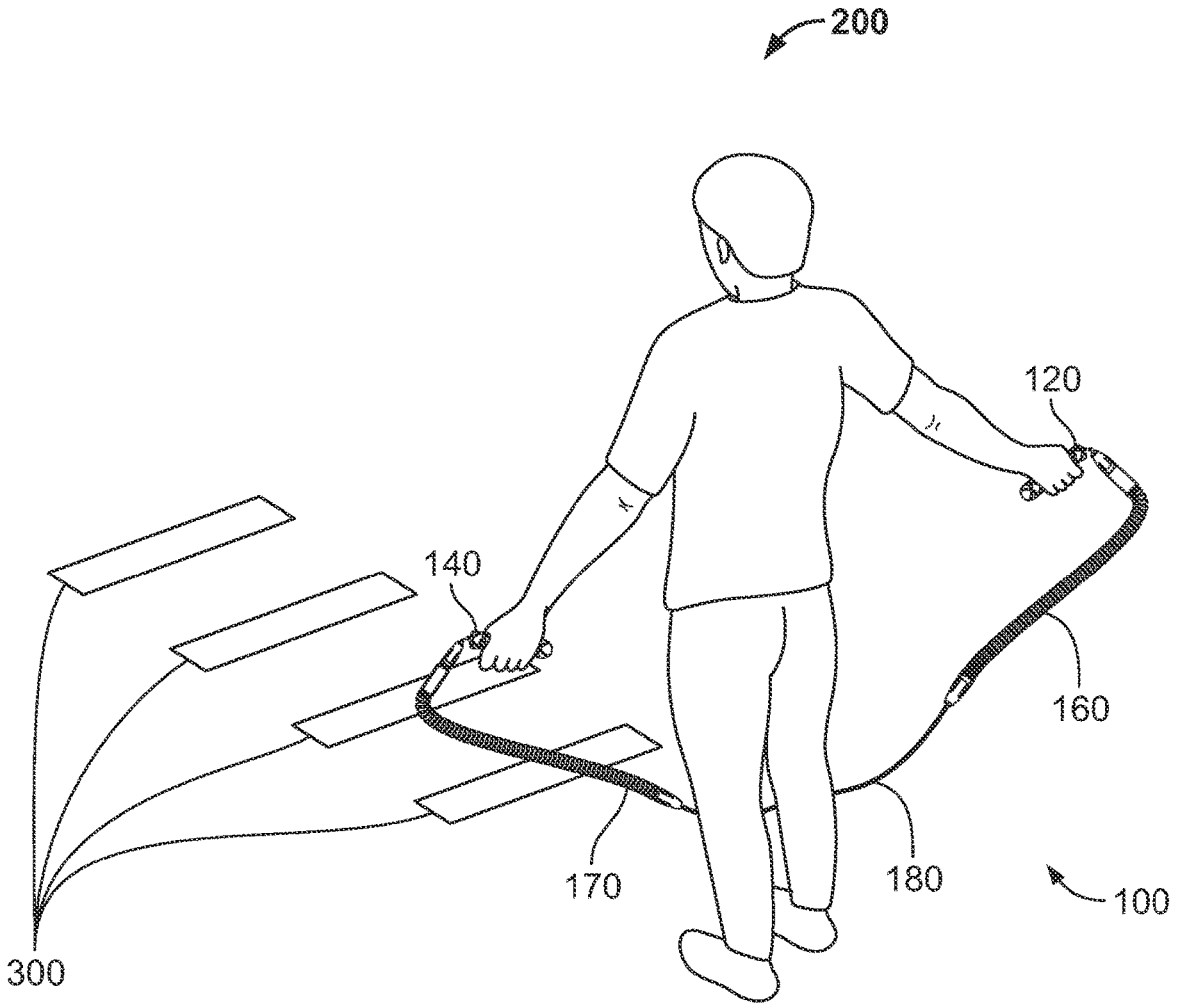
FIG. 8 illustrates an environment configured for use of the training device of FIG. 1.

Turning to FIGS. 5A-5D, user 200 may instead train upper body strength, core stability, and hand-eye coordination by swinging training device 100 in a figure-8 pattern, for example, or any other cyclical pattern the user 200 may wish to attempt. The elasticity of training device 100 overall provided by elastic members 160, 170 causes training device 100 to provide a continuously varying load at handles 120, 140. Training device 100 thus presents a unique challenge to user 200 while user 200 attempts to smoothly trace an intended shape with training device 100.

User 200 may train each side of the body individually by holding both handles 120, 140 in one hand, as shown in FIGS. 5A-5D. Alternatively, user 200 may train both sides of the body simultaneously by holding each handle 120, 140 in a different hand as shown in FIGS. 6A-6D. Such exercises may be used individually or in conjunction to correct asymmetries in muscle strength and coordination. User 200 may trace different shapes, such as, for example, a circle, by holding handles 120, 140 in one hand or in separate hands as shown in FIGS. 7A-7D as well, depending on goals and preferences of user 200.

User 200 may make reference to external indicia 300 such as those illustrated by way of example in FIG. 8 for objective measurement of user's 200 exercise with training device 100. User 200 may swing training device 100 in any pattern at indicia 300 to ensure an exercise is performed at a constant intensity, or to measure the intensity at which an exercise is performed. For example, user 200 may stand a distance away from a selected indicium 300 that is greater than half of a total length of training device 100, then attempt to reach or strike the selected indicium 300 with training device 100. User 200 would thus need to swing training device 100 with a certain minimum force to reach or strike the selected indicium 300. By such reference, user 200 may therefore use indicia 300 and differing members 160, 170, 180 of training device 100 to measure the intensity of exercise or plan an exercise intensity progression.

Figure 9:
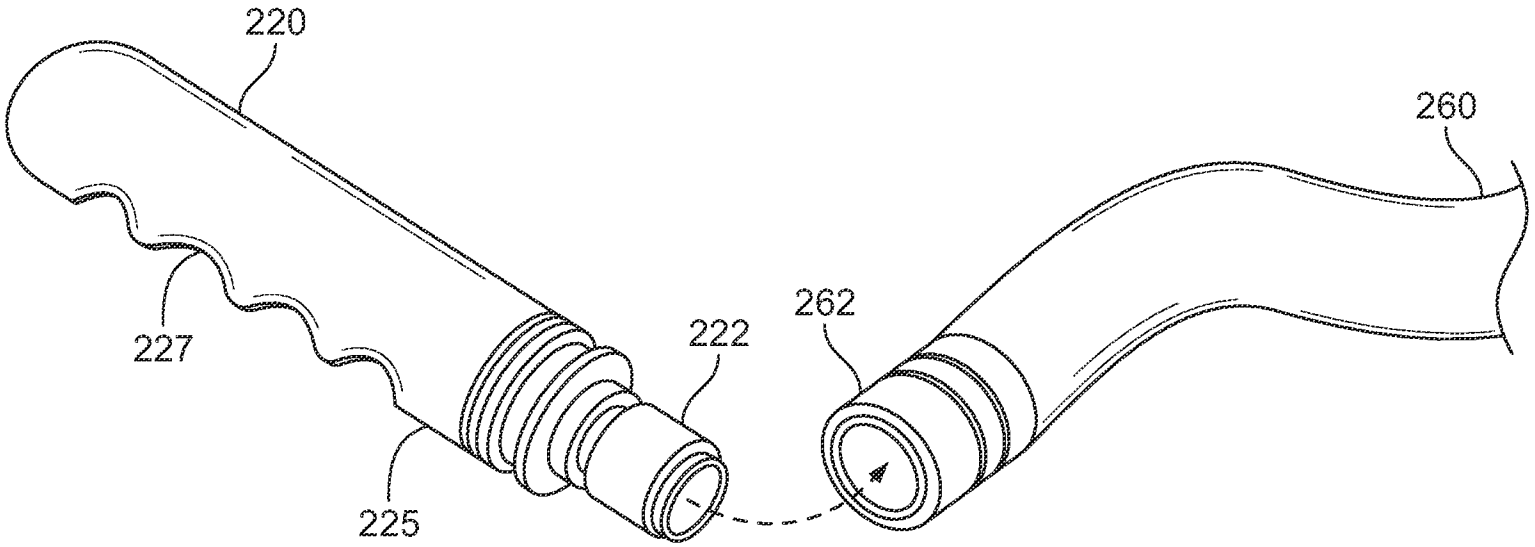
FIG. 9 is a perspective view of an alternative handle connection mechanism for the training device of FIG. 1.

An alternative handle 220 for a training device is illustrated in FIG. 9. Handle 220 may be attachable to first elastic portion 260 by, for example, a quick-connect mechanism. In the illustrated example, end 222 of first handle 220 is a post defining an annular channel, and first end 262 of a first elastic portion 260 according to an embodiment modified for use with handle 220 is a collar. Collar 262 may be retracted to allow radially outward travel of bearings (not illustrated) as post 222 is inserted or removed. When collar 262 is allowed to return to an unretracted position while post 222 is disposed therein, collar 262 retains the bearings in a radially narrow configuration that engages the annular channel of post 222, thus preventing first handle 220 from separating from first elastic portion 260. Handles 220 according to the embodiment of FIG. 9 can be included in a kit for a training device 100 according to an embodiment of the device using quick-connect couplings instead of the resilient buckle shown in FIG. 3.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A training device for exercising, the training device comprising:

a first handle having a first connection end;

a second handle having a second connection end;

a first elastic member having opposing ends, one of the opposing ends of the first elastic member removably coupled to the first connection end;

a second elastic member having opposing ends, one of the opposing ends of the second elastic member removably coupled to the second connection end; and an intermediate member having opposing ends, a first end of the opposing ends of the intermediate member removably coupled to the other of the opposing ends of the first elastic member, and a second end of the opposing ends of the intermediate member removably coupled to the other of the opposing ends of the second elastic member, wherein a first substantially uniform thickness between a portion of the first connection end and a portion of the first end of the intermediate member is substantially equivalent to a second substantially uniform thickness between a portion of the second connection end and a portion of the second end of the intermediate member, and wherein a third substantially uniform thickness between the first and second ends of the intermediate member is less than the first and second substantially uniform thicknesses.

2. The training device of claim 1, wherein the first and second elastic members have a neutral length between six and twenty four inches.

3. The training device of claim 1, wherein the first and second elastic members have a neutral length and an extended length that is greater than the neutral length.

4. The training device of claim 1, wherein the intermediate member is inelastic.

5. The training device of claim 1, wherein the first and second elastic members each have an elastic portion and an inelastic portion.

6. The training device of claim 5, wherein the inelastic portion of each of the first and second elastic members is couplable proximate to a respective one of the first and second handles.

7. The training device of claim 5, wherein the inelastic portion of each of the first and second elastic members is couplable proximate to either of the first and second ends of the intermediate member.

8. The training device of claim 1, wherein the first and second handles are elongate.

9. The training device of claim 1, wherein the first and second elastic members have a different resistance to one another.

10. A training device for exercising, the training device comprising:

a first handle having a first connection end;

a second handle having a second connection end;

a first pair of elastic members each having opposing first and second ends, the first ends removably coupled to the first and second connection ends, respectively;

a first intermediate member having opposing first and second ends removably coupled to the second ends of the first pair of elastic members, respectively, wherein a first substantially uniform thickness between a portion of the first connection end and a portion of the first end of the first intermediate member is substantially equivalent to a second substantially uniform thickness between a portion of the second connection end and a portion of the second end of the first intermediate member, wherein a third substantially uniform thickness between the first and second ends of the first intermediate member is less than the first and second substantially uniform thicknesses, and wherein each of the first and second ends of the first intermediate member is removably couplable to either of the first and second ends of each of the first pair of elastic members.

11. The training device of claim 10, wherein each of the first and second connection ends of the first and second handles, respectively, is removably couplable to either of the first and second ends of each of the first pair of elastic members.

12. The training device of claim 10, further comprising:

a second pair of elastic members each having opposing first and second ends, wherein each of the first and second ends of the first intermediate member is couplable to either of the first and second ends of each of the second pair of elastic members.

13. The training device of claim 12, wherein the first pair of elastic members have a different resistance than the second pair of elastic members.

14. The training device of claim 12, wherein the first pair of elastic members have a different neutral length than the second pair of elastic members.

15. The training device of claim 10, further comprising:

a second intermediate member having opposing ends, wherein the first intermediate member has a first length and the second intermediate members has a second length greater than the first length.

16. The training device of claim 10, wherein each of the first pair of elastic members has an elastic portion and an inelastic portion.

17. The training device of claim 16, wherein the inelastic portion of each of the first pair of elastic members is couplable proximate to either of the first and second ends of the first intermediate member.

18. The training device of claim 16, wherein the first connection end of the first handle is couplable to the elastic portion of one of the first pair of elastic members and the second connection end of the second handle is couplable to the inelastic portion of the other of the first pair of elastic members.

19. The training device of claim 18, wherein the inelastic portion of the one of the first pair of elastic members is couplable to one of the first and second ends of the first intermediate member and the elastic portion of the other of the first pair of elastic members is couplable to the other of the first and second ends of the first intermediate member.

20. A training device for exercising, the training device comprising:

a first handle having a first gripping portion and a first coupling portion;

a second handle having a second gripping portion and a second coupling portion;

a first elastic member having a first end removably coupled to the first coupling portion;

a second elastic member having a first end removably coupled to the second coupling portion; and an intermediate member having first and second ends, the first end of the intermediate member removably coupled to a second end of the first elastic member, and the second end of the intermediate member removably coupled to a second end of the second elastic member, wherein a first substantially uniform thickness between a portion of the first coupling portion and a portion of the first end of the intermediate member is substantially equivalent to a second substantially uniform thickness between a portion of the second coupling portion and a portion of the second end of the intermediate member, wherein a third substantially uniform thickness between the first and second ends of the intermediate member is less than the first and second substantially uniform thicknesses, wherein each of the first and second ends of the intermediate member is removably couplable to either of the first and second ends of the first and second elastic members, and wherein each of the first and second coupling portions of the first and second handles, respectively, is removably couplable to either of the first and second ends of the first and second elastic members.

21. The training device of claim 20, wherein each of the first and second elastic members have a neutral length and an extended length greater than the neutral length.

* * * * *